US005618238A

United States Patent [19]

Kruse et al.

[11] Patent Number: 5,618,238

[45] Date of Patent: Apr. 8, 1997

[54] USER INPUT SELECTION DEVICE AND AUTOMATED BOWLING COACHING SYSTEM IN AN AUTOMATIC BOWLING SCORING SYSTEM

[75] Inventors: Richard A. Kruse, Dillard, Ga.; Roger L. Grossenbacher, Spring Lake; James S. Chan, Muskegon, both of Mich.

[73] Assignee: Brunswick Bowling & Billards Corp., Muskegon, Mich.

[21] Appl. No.: 370,032

[22] Filed: Jan. 9, 1995

[51] Int. Cl.[6] ..... A63D 5/04

[52] U.S. Cl. ..... 473/70; 473/58; 473/55

[58] Field of Search ..... 473/54, 55, 71, 473/58, 64, 69–70, 101; 364/410–411; 345/156, 157, 171–173, 181; 395/118, 155, 161; 434/249

[56] References Cited

U.S. PATENT DOCUMENTS

| | | | |
|---|---|---|---|
| 4,773,644 | 9/1988 | Lashman | 473/55 |
| 4,887,813 | 12/1989 | Chiles, III et al. | 473/70 |
| 5,059,125 | 10/1991 | Maclay, Sr. et al. | 473/54 |
| 5,198,976 | 3/1993 | Form et al. | 473/71 |
| 5,241,379 | 8/1993 | Tsujita | 364/410 |
| 5,255,185 | 10/1993 | Mowers et al. | 364/411 |

OTHER PUBLICATIONS

Using ActonWriter to Create Office Actions Action Writer for Windows Student Guide, Copyright 1992, Gary C. Hoge.

*Primary Examiner*—Jessica Harrison
*Assistant Examiner*—Mark A. Sager
*Attorney, Agent, or Firm*—Price, Heneveld, Cooper, DeWitt & Litton

[57] ABSTRACT

A bowling scoring system having a graphic user interface includes an input selection device for receiving user input selections. The bowling scoring system is responsive to a pin-fall sensor to compute bowlers' scores which are displayed to provide information to the bowler. The system includes a controller program having various program states for performing a particular one of a plurality of functions. A plurality of input selection keys juxtaposed with the display device to provide input to the controller. Softkey indicia areas on the display device are associated with one of its input selection keys. The controller is responsive to the state of the program for displaying a particular label in at least one of the indicia areas and for performing a function associated with the displayed label in response to actuation of the one of the input selection keys associated with the labeled indidia area. The system further includes a bowler coaching device that identifies the pattern of pins that remain standing after a bowler has rolled a first ball, and determines the contact area where the ball should contact the remaining pins to convert the leave. The coaching device further determines where the bowler should place the ball on the foul line and where the ball should travel between the lane targets. In addition, the coaching device determines where the bowler should stand when starting an approach. The information is relayed by the coaching device to the bowler via the scoring system displays. The coaching device may also display the difficulty level for converting the leave and display whether the standing pins constitute a split.

37 Claims, 29 Drawing Sheets

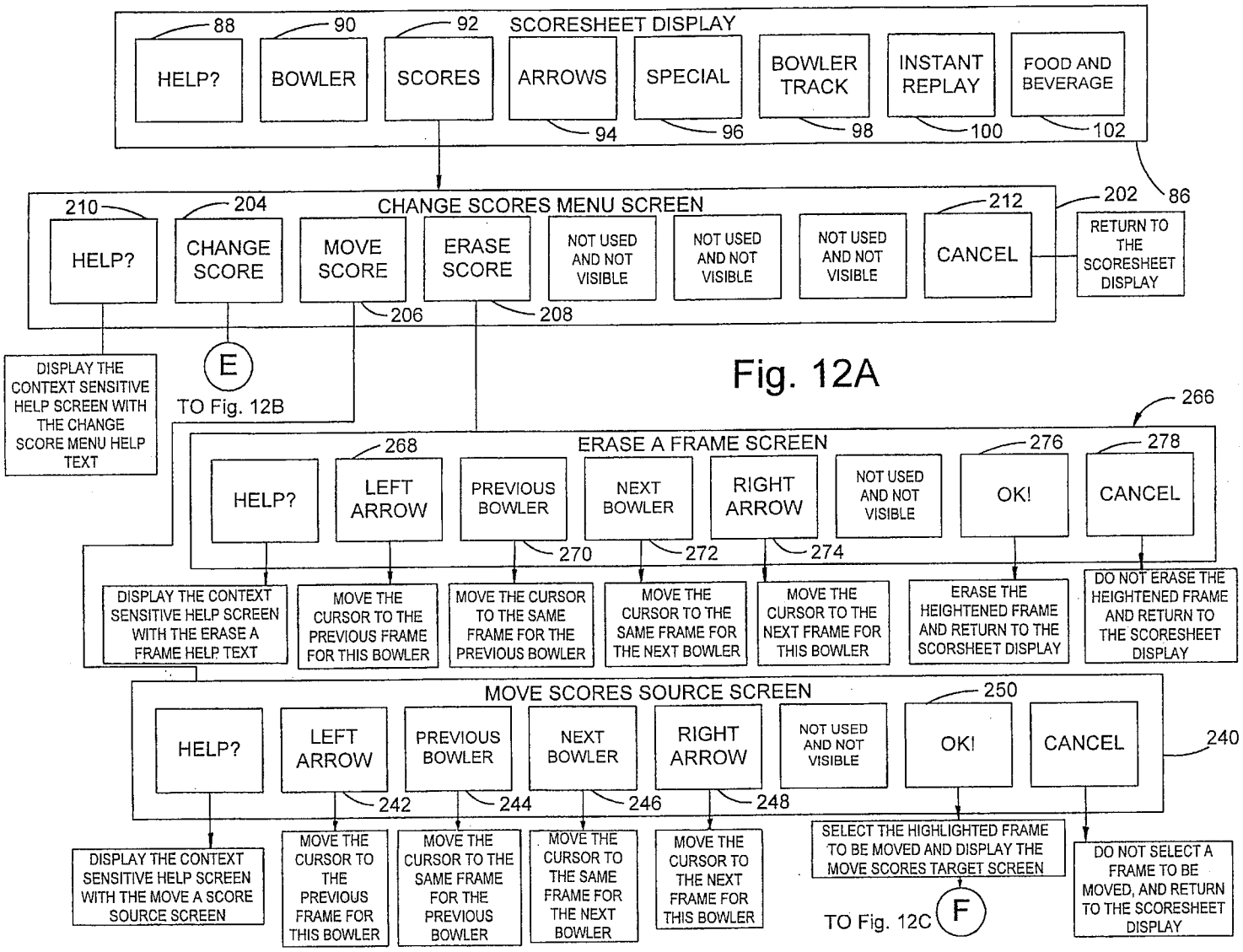
SCORESHEET DISPLAY
86
HELP?
88
BOWLER
90
SCORES
92
ARROWS
94
SPECIAL
96
BOWLER TRACK
98
INSTANT REPLAY
100
FOOD AND BEVERAGE
102
CHANGE SCORES MENU SCREEN
202
HELP?
210
CHANGE SCORE
204
MOVE SCORE
206
ERASE SCORE
208
NOT USED AND NOT VISIBLE
NOT USED AND NOT VISIBLE
CANCEL
212
RETURN TO THE SCORESHEET DISPLAY
DISPLAY THE CONTEXT SENSITIVE HELP SCREEN WITH THE CHANGE SCORE MENU HELP TEXT
E
TO Fig. 12B
Fig. 12A
ERASE A FRAME SCREEN
266
HELP?
268
LEFT ARROW
PREVIOUS BOWLER
270
NEXT BOWLER
272
RIGHT ARROW
274
NOT USED AND NOT VISIBLE
OK!
276
CANCEL
278
DISPLAY THE CONTEXT SENSITIVE HELP SCREEN WITH THE ERASE A FRAME HELP TEXT
MOVE THE CURSOR TO THE PREVIOUS FRAME FOR THIS BOWLER
MOVE THE CURSOR TO THE SAME FRAME FOR THE PREVIOUS BOWLER
MOVE THE CURSOR TO THE SAME FRAME FOR THE NEXT BOWLER
MOVE THE CURSOR TO THE NEXT FRAME FOR THIS BOWLER
ERASE THE HEIGHTENED FRAME AND RETURN TO THE SCORSHEET DISPLAY
DO NOT ERASE THE HEIGHTENED FRAME AND RETURN TO THE SCORESHEET DISPLAY
MOVE SCORES SOURCE SCREEN
240
HELP?
242
LEFT ARROW
PREVIOUS BOWLER
244
NEXT BOWLER
246
RIGHT ARROW
248
NOT USED AND NOT VISIBLE
OK!
250
CANCEL
DISPLAY THE CONTEXT SENSITIVE HELP SCREEN WITH THE MOVE A SCORE SOURCE SCREEN
MOVE THE CURSOR TO THE PREVIOUS FRAME FOR THIS BOWLER
MOVE THE CURSOR TO THE SAME FRAME FOR THE PREVIOUS BOWLER
MOVE THE CURSOR TO THE SAME FRAME FOR THE NEXT BOWLER
MOVE THE CURSOR TO THE NEXT FRAME FOR THIS BOWLER
SELECT THE HIGHLIGHTED FRAME TO BE MOVED AND DISPLAY THE MOVE SCORES TARGET SCREEN
DO NOT SELECT A FRAME TO BE MOVED, AND RETURN TO THE SCORESHEET DISPLAY
F
TO Fig. 12C

USER INPUT SELECTION DEVICE AND AUTOMATED BOWLING COACHING SYSTEM IN AN AUTOMATIC BOWLING SCORING SYSTEM

BACKGROUND OF THE INVENTION

This invention relates generally to bowling scoring systems and, more particularly, to bowling scoring systems having a graphic user interface. More particularly, the invention relates to a user interface that is intuitive in use and provides helpful information to the bowler.

Automatic scoring systems for bowling centers have been provided which respond to outputs produced by a pin-fall monitor in order to automatically score each bowler's game. The automatic scoring system typically includes a scoring console having a keyboard and a CRT display for entering the names of the bowlers, correcting scoring errors, and the like. The CRT display may also display video images, including the scores of the bowlers, as well as various other materials such as exciter graphics, instant replay of the bowler, and the like. Such systems typically include overhead monitors, which display the same video displayed on the scoring console display, in order to allow viewing by a larger group including other bowling teams, spectators, and the like. One such system is disclosed in commonly owned U.S. Pat. No. 5,255,185 for a BOWLING CENTER VIDEO DISPLAY SYSTEM, the disclosure of which is hereby incorporated herein by reference.

In addition to the above-described functions, the scoring system typically includes special features intended to assist the bowler in improving his or her score as well as specialized features such as the ordering of food and beverage service. The inclusion of all such functions in a bowling scoring system results in a proliferation of the number of entries that must be selected by the bowler in order to operate the bowling scoring system to its fullest capacity. Indeed, if each option were assigned to a discrete input key, the input keypad would require more than 125 keys.

One approach to reducing the number of selection keys required has been to organize the selections into various menus. The menu system operates as follows. The user selects a general function to be performed and is then presented with a number of possible selections. A selection is entered by a key that is associated with the selection by a number or letter on the keyboard. The selection will then generate another sub-menu requiring a further selection by the user. Typically, up to four menu levels are required in order to provide all of the user inputs to carry out a particular function. While such menu structures have reduced the number of keys on the keyboard, they are often confusing and cumbersome to operate. The result is that the user is not always able to achieve the desired function and spends an excessive amount of time attempting to achieve the attendant function.

One of the known functions for assisting a bowler in improving his or her score is to indicate to the bowler, after the bowler has thrown the first ball, the contact area where a second ball should contact the pattern of pins standing after the first ball in order to convert the leave. Such indication is typically provided at the curtain area above the pinsetter in the form of an illuminated arrow juxtaposed with an illuminated display of the leave. Such spare-conversion aid provides the minimum amount of information that is useful in assisting the bowler in converting the leave.

SUMMARY OF THE INVENTION

The present invention provides a bowling scoring system having a unique graphic user interface that is both intuitive and straightforward in operation, as well as providing special features for assisting the bowler in improving his or her score.

A bowling scoring system, according to a first aspect of the invention, includes a user input selection device for receiving user input selections. The input selection device includes a controller with a program having various program states. The controller is responsive to the state of the program for performing a particular one of a plurality of functions. A plurality of input selection keys are juxtaposed with the display device for providing inputs to the controller. A plurality of key indicia areas are provided on the display device, each of the areas are associated with one of the input selection keys. The controller is responsive to the state of the program for displaying a particular label in at least one of the indicia areas and for performing a function associated with the display area in response to actuation of the input selection key associated with the labeled indicia area. This "soft-key" feature provides an effective technique for receiving user input selections without requiting the large number of sub-menu layers required in the prior art input selection devices. The input selection keys and the key indicia areas are preferably distributed across the bottom of the display device. In this manner, the functions are readily available for selection by the user at all times. In particular program states, two of the input selection keys are provided for causing scrolling of selection items displayed on the display device.

This allows an exceptionally flat selection structure, which is intuitive to use and results in the user being able to carry out the intended selection.

A bowling scoring system, according to another aspect of the invention, includes a bowler coaching device for advising a bowler of a strategy for converting a leave. The coaching device includes a leave identification means responsive to the pin-fall sensor for determining the identity of a pattern of pins standing after a bowler rolls a first ball. A conversion analysis means is provided that is responsive to the leave identification means for determining the contact area where a ball should contact the pattern of pins standing in order to convert the leave. The conversion analysis means further determines bowler actions required in order to place the ball in the contact area; for example, the location of a target portion, or board, of the lane where the ball should be delivered in order to place the ball in the contact area as well as location of a placement of the bowler's feet at the start of the bowler's approach required to deliver the ball to the target portion of the lane. The bowler coaching device further includes a display generation means that is responsive to the conversion analysis means for causing the display device to display the contact area and the bowler actions required for the pattern of pins standing after the bowler rolls the first ball. Preferably, the graphic generation means generates an image of the pattern of pins and a ball in the contact area. The image may be a graphic image stored in the controller's memory. The coaching device may further include input means for receiving a user selection of the hand used by the bowler to deliver the ball. The controller determines and displays the bowler's action as a function of the hand used by the bowler to deliver the ball. A bowler coaching device, according to this aspect of the invention, may further include information regarding the difficulty of converting the leave, as well as information whether the leave is considered a split.

These and other objects, advantages, and features of this invention will become apparent upon review of the following specification in conjunction with the drawings.

BRIEF DESCRIPTION OF THE DRAWINGS

FIGS. 12A–12C are a diagram of the input structure for the "scores" function;

DESCRIPTION OF THE PREFERRED EMBODIMENT

Figure 1:
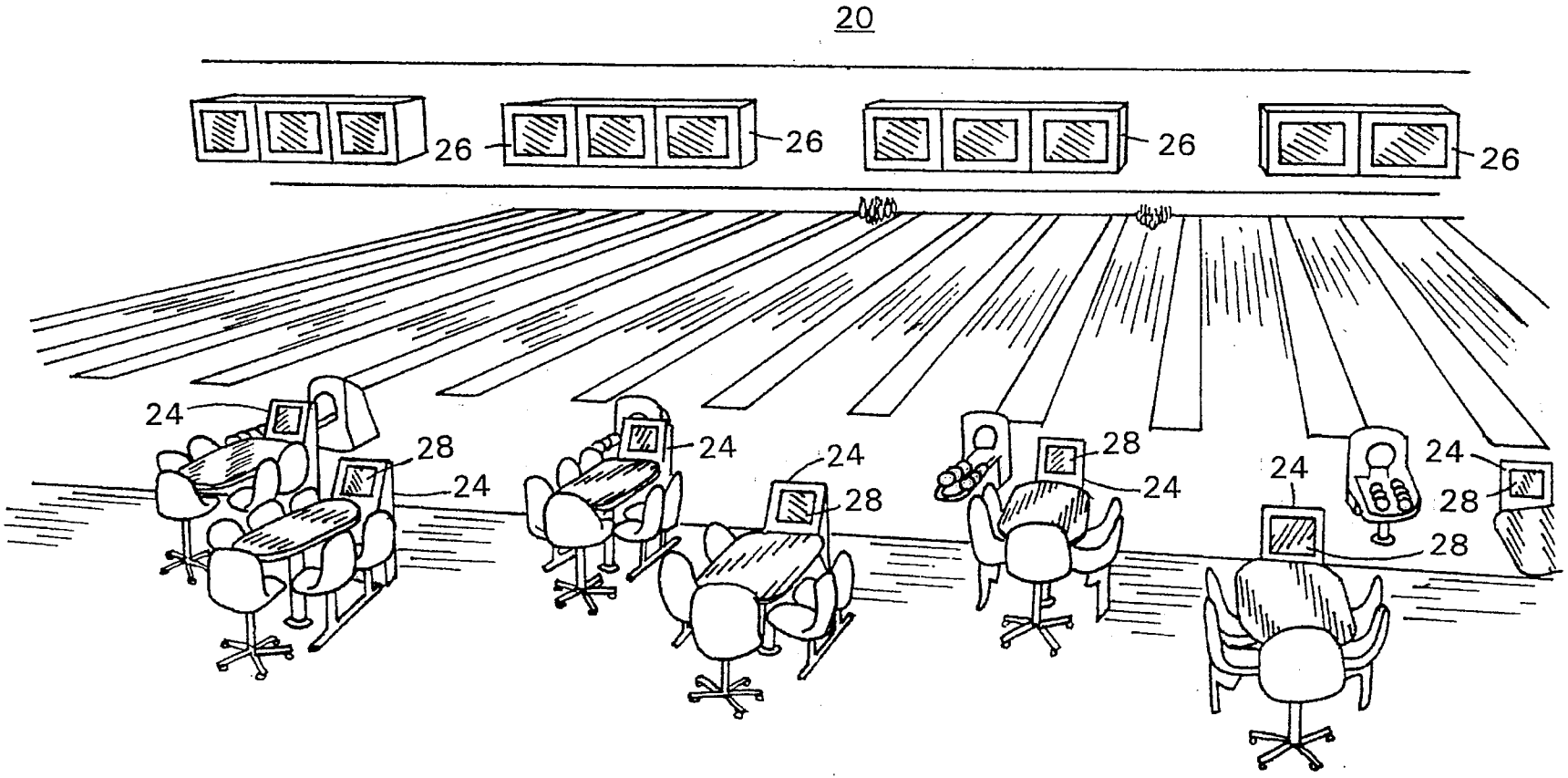
FIG. 1 is a perspective view of a bowling center including a bowling scoring system, according to the invention.

Referring now specifically to the drawings and the illustrative embodiments depicted therein, the bowling center illustrated in FIG. 1 includes an automatic scoring system 20 including a scoring processor 22 (FIG. 2) and a plurality of scoring consoles 24. Automatic scoring system 20 may additionally include a plurality of overhead monitors 26 in order to display the same images displayed on displays 28 associated with each scoring console 24. However, the images displayed on overhead monitors 26 are not limited to those displayed on scoring consoles 24. For example, if overhead monitors 26 are grouped into three units for each pair of lanes, as illustrated in FIG. 1, then two of the three monitors may display the same graphic images as the scoring consoles 24 associated with the two lanes with the third monitor displaying other graphic images, such as a television program, video recordings, or the like.

In the illustrated embodiment automatic scoring system 20 utilizes an open architecture which allows assembly of the system substantially from off-the-shelf components, utilizing an ISA bus standard and an Ethernet communication network. In this manner, the scoring processor may be readily upgraded for enhanced microprocessor technology and the communication system is supported by industrial standard communication technology. Each scoring processor 22 includes a mother board 30 having off-the-shelf components, such as a 486 processor 32, a PC/AT chip set 34, and other conventional components 36*a*–36*d*. A mother board bus 38, which has a protocol according to ISA standards, supports a multiplexed graphics interface card 40 for supplying video signals to displays 28 for a pair of scoring consoles 24, as well as a pair of overhead monitors 26. Mother board bus 38 additionally interfaces with a scorer interface card 42, which, in turn, provides interface with a pair of scoring consoles 24 for data other than graphic and audio data. A pair of sound cards 44 provide interface between ISA bus 38 and microphones 60 in a pair of scoring consoles 24. An Ethernet card 46 interfaces ISA bus 38 with a 10 Base T hub utilizing standard Ethernet protocol. Each scoring console 24 includes a micro-controller 48 in order to receive inputs from a keypad 50 or a touch-screen 54 and to communicate with scoring processor 22. Micro-controller 48 additionally receives inputs from a card reader 52. A multiplexer 56 allows a microphone 58 and a speaker 60 to be utilized with either a stereo input channel received from a sound card 44 or from an intercom multiplexer 62.

Figure 3:
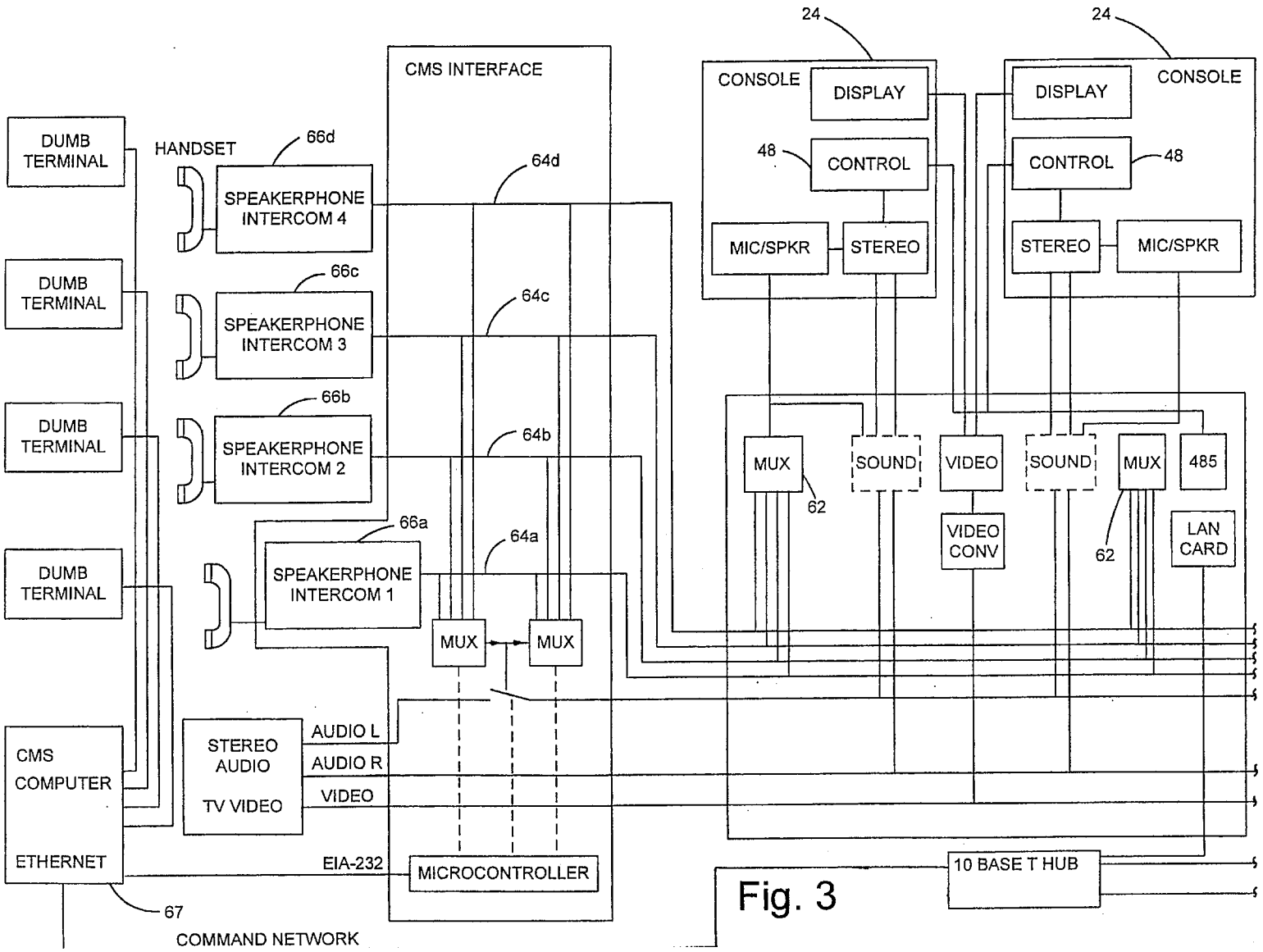
FIG. 3 is an electronic block diagram of an intercom system within the bowling scoring system.

Intercom multiplexer 62 multiplexes each microphone/speaker combination of each console 24 onto one of four intercom lines 64*a*–64*d* (FIG. 3). Each intercom line 64*a*–64*d* is connected to a speaker phone 66*a*–66*d* at a central control console 67. In this manner, a request for intercom connection at any console 24 may be intercepted by any speaker phone 66*a*–66*d*. This allows more than one intercom request to be serviced at a time, thus avoiding the necessity for stacking requests.

Figure 4:
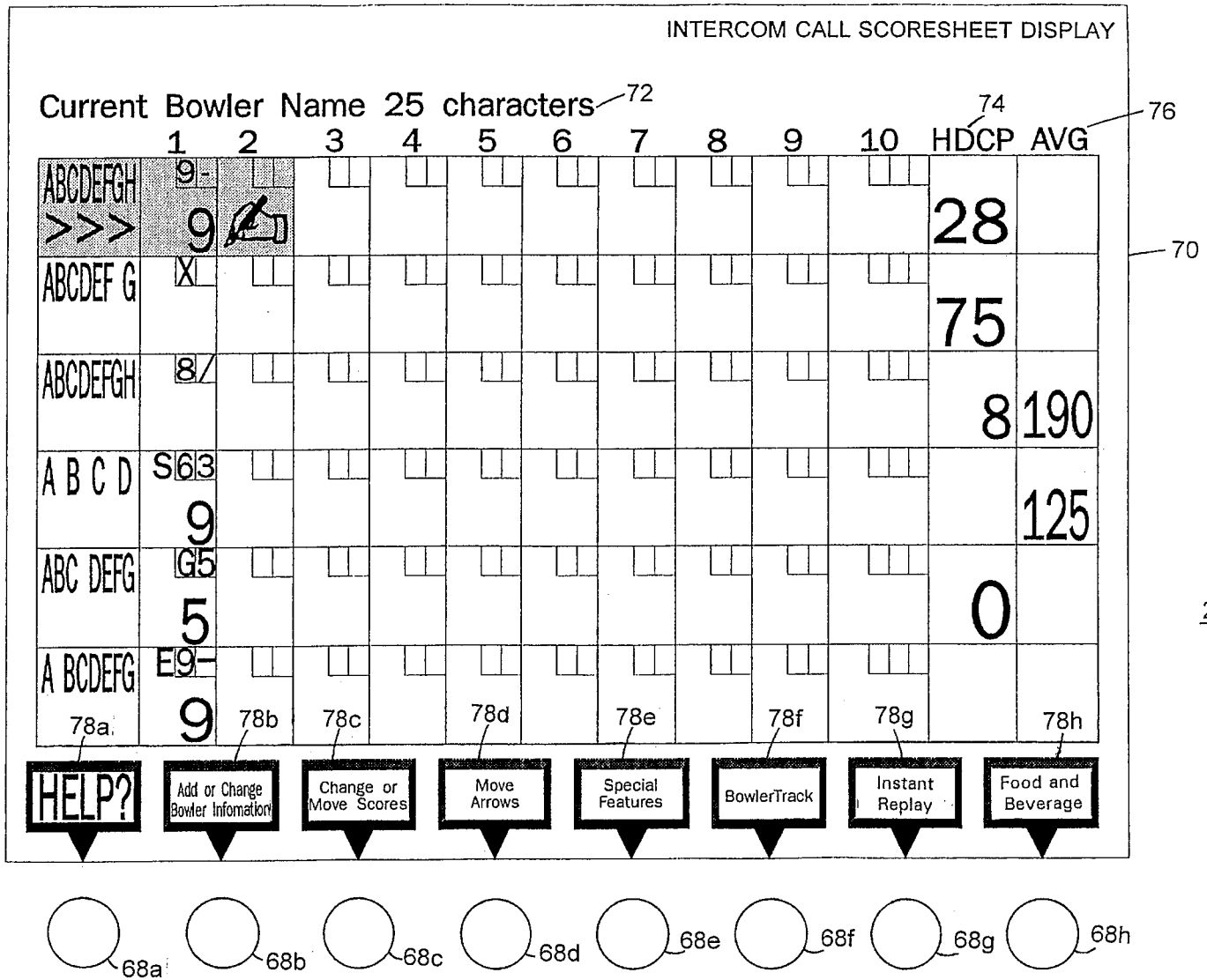
FIG. 4 is a soft-key user input device, according to the invention.
Figure 5:
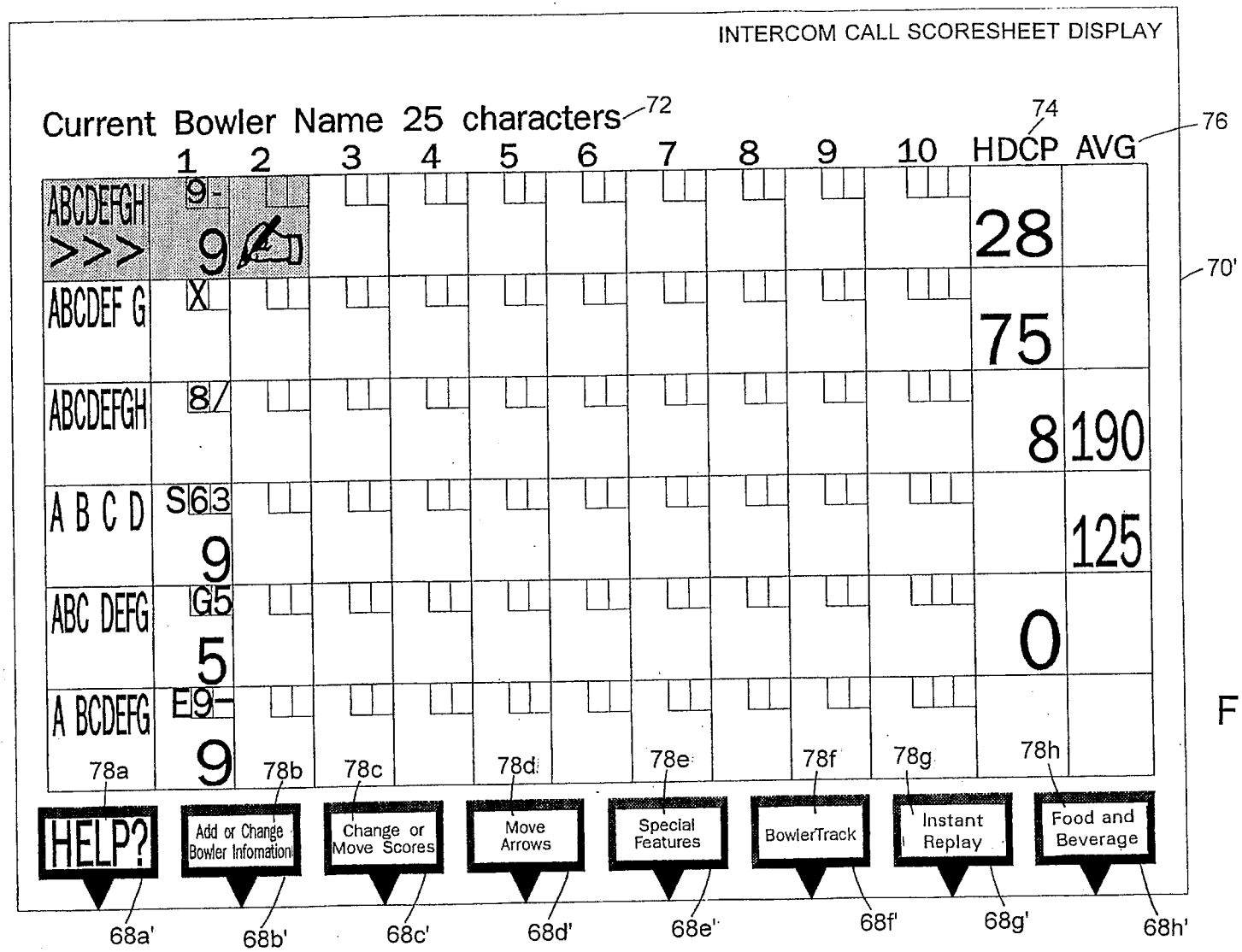
FIG. 5 is the same view as FIG. 4 of an alternative embodiment.

Scoring console 24 includes a plurality of unlabeled user input selection buttons or switches 68*a*–68*h*, which are distributed along the bottom of a display surface 70 (FIG. 4). Display 70 is illustrated in FIG. 4 displaying a score-sheet for six bowlers including the name of the current bowler at 72, as well as the handicap 74 and average 76 of each bowler. Display surface 70 additionally includes a plurality of indicia areas 78*a*–78*h*, which are juxtaposed with the input keys 68*a*–68*h*. In the embodiment illustrated in FIG. 4, input keys 68*a*–68*h* are mechanical key switches which are located on scoring console 24 adjacent to display surface 70. In FIG. 5, a much-screen display surface 70' includes a combination of user selection keys 68*a*'–68*h*' directly overlaying the associated indicia areas 78*a*–78*h*. Each key indicia area 78*a*–78*h* includes an indicia that prompts the user of the function performed by the corresponding selection key 68*a*–68*h*, 68*a*'68*h*'. As will be set forth in more detail below, the indicia in each indicia area is established by the state of the software operating controller 48. Likewise, the function carried out by actuation of each of the selection keys changes dependent upon the state of the software of the micro-controller 48. This soft-key specification of the function of each key provides a unique input selection system.

Figure 6:
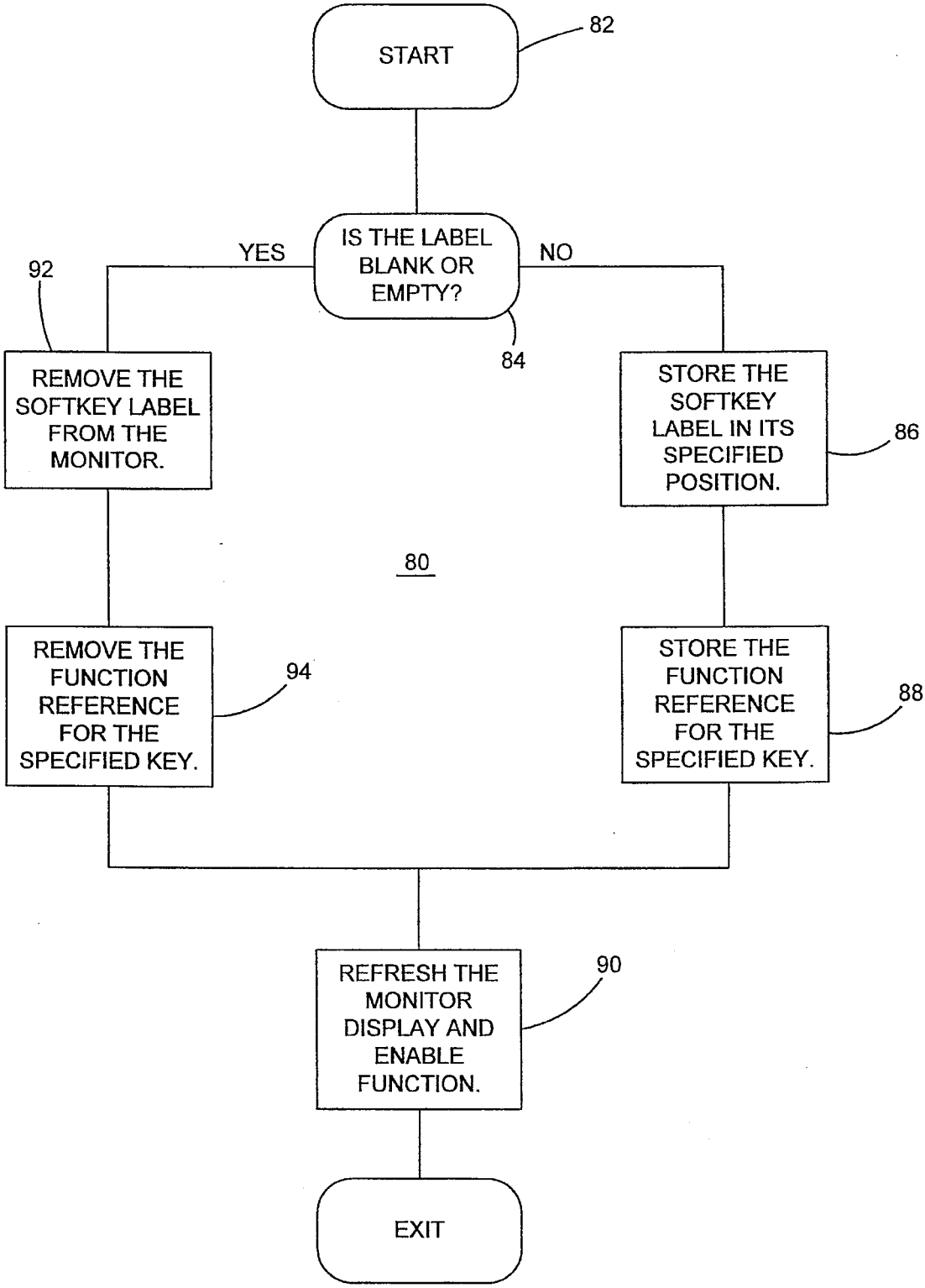
FIG. 6 is a flowchart of a soft-key input function.

Operation of the soft-key display is controlled by a soft-key routine 80 (FIG. 6). For each pass through routine 80, beginning at 82, the control determines whether each of the indicia areas is blank or empty at 84. If the area is not blank, then the soft-key label is stored in the specific indicia area at 86 and the function associated with the specific key is set at 88. The monitor display is refreshed and the associated function enabled at 90. If it is determined at 84 that the label is blank, then the soft-key label for the particular indicia area is removed at 92. The associated function is removed at 94 and the monitor display is refreshed at 90.

The soft-key system enables the program of micro-controller 48 to set and change the text label for each key 68*a*–68*h*, 68*a*'–68*h*' and its subsequent function at any time depending on the state of the program. The soft-key routine 80 matches the keyboard input with the soft-key map and performs the specific function when the key is actuated by the user. The soft-key is set up by displaying the soft-key label and enabling the specified function for the soft-key. During the execution of the software, a soft-key may change its meaning and subsequent action any number of times.

Figure 7:
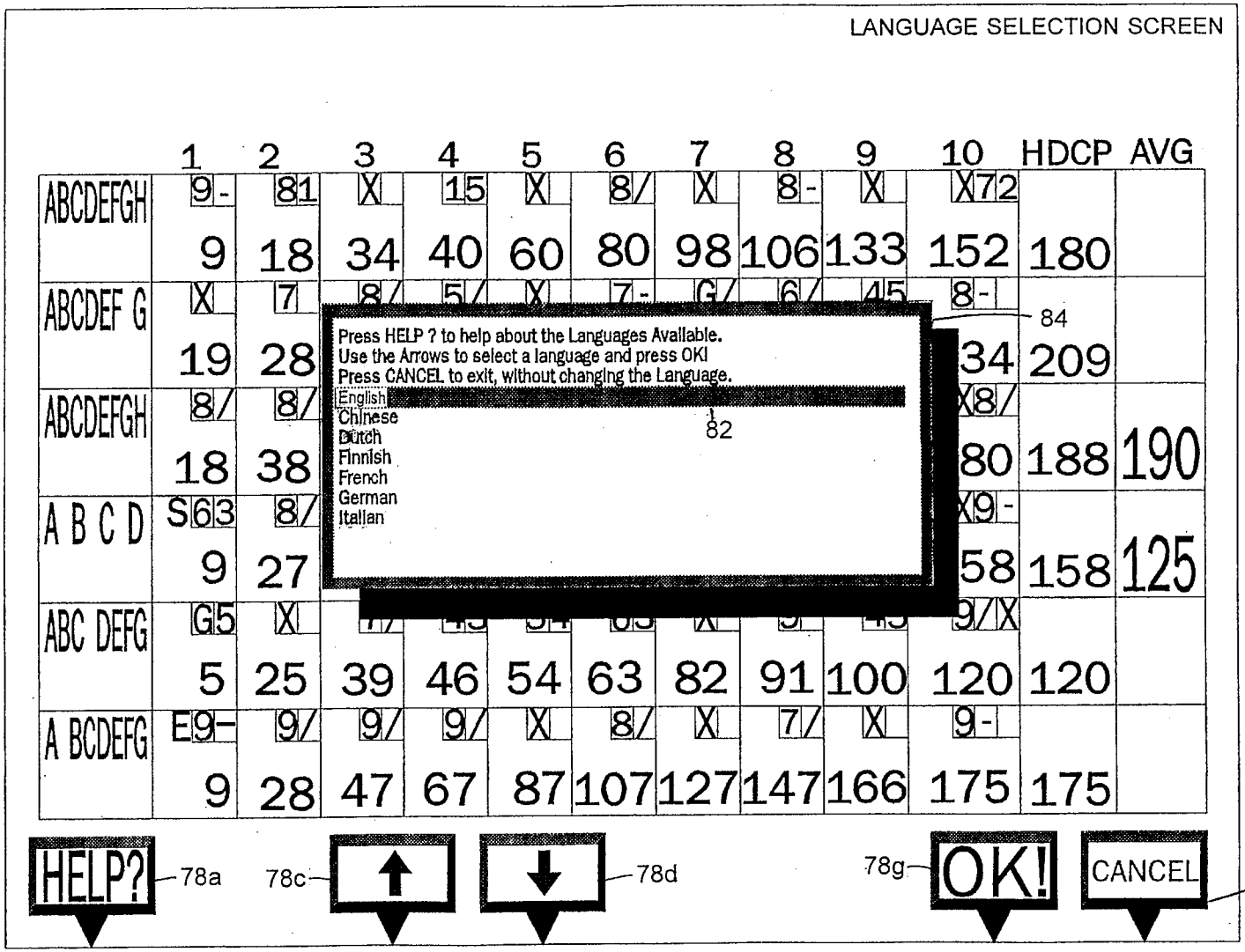
FIG. 7 is a soft-key display generated during a particular state of the program.
Figure 8:
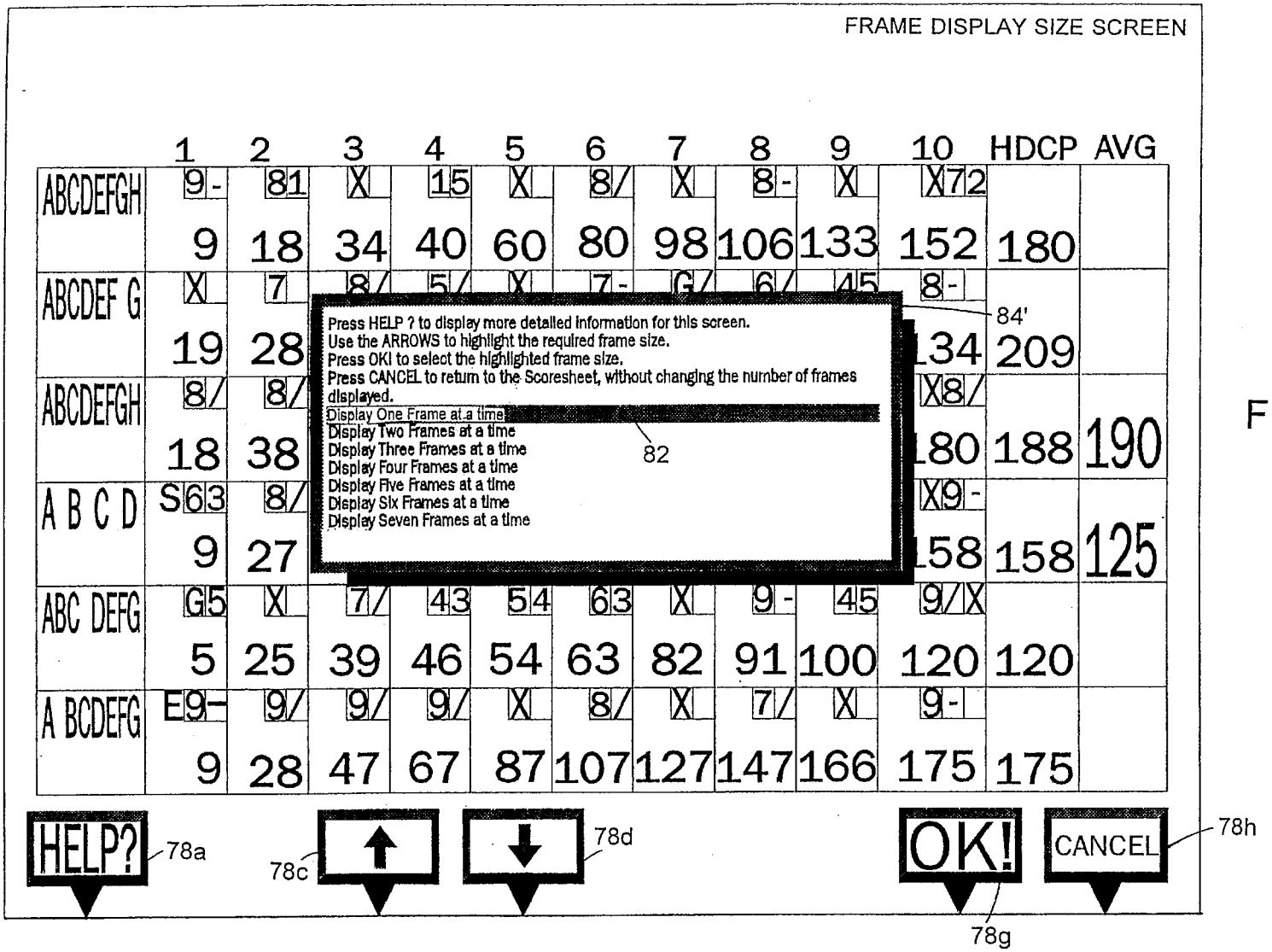
FIG. 8 is the same view as FIG. 7 generated during a different state of the program.
Figure 9:
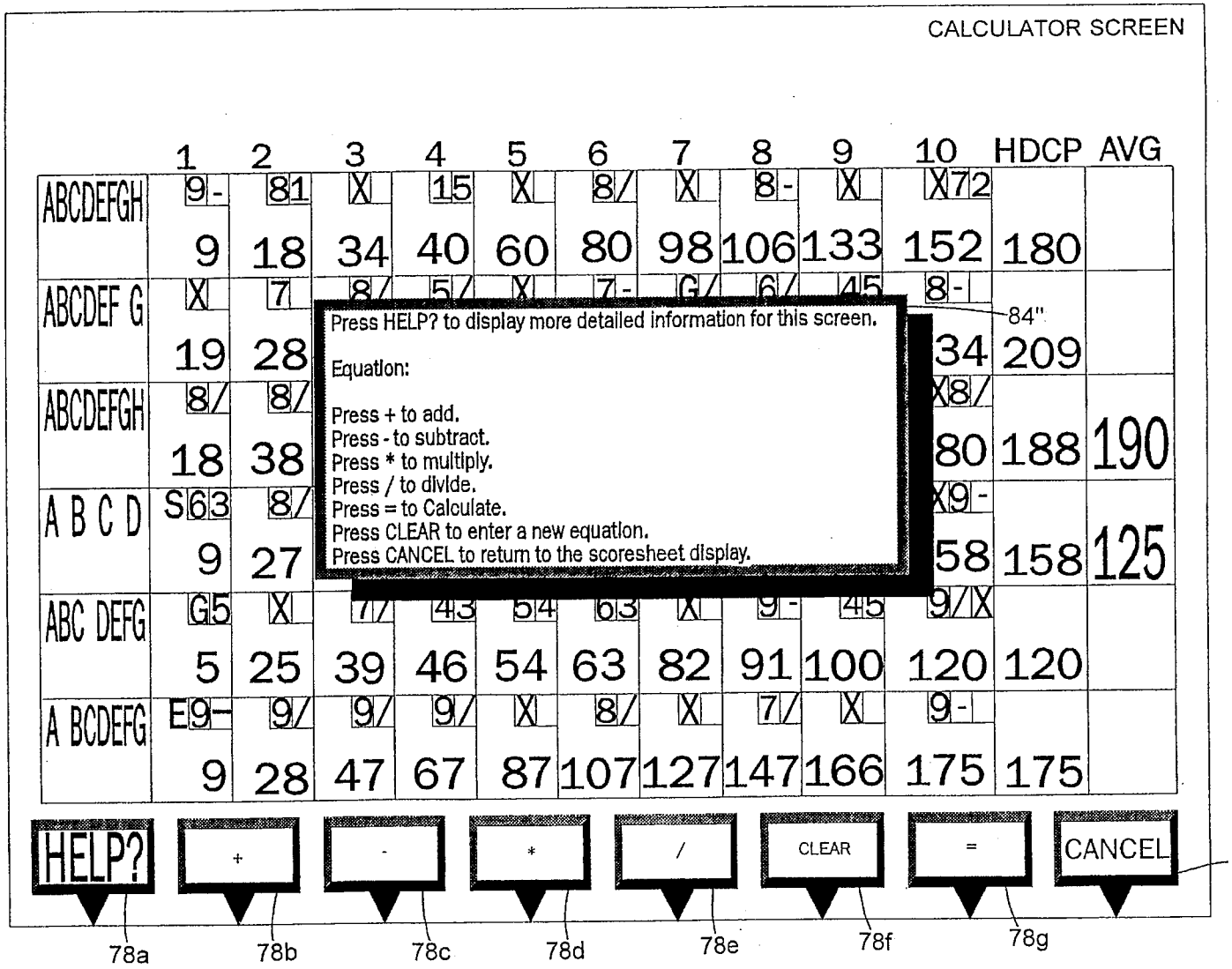
FIG. 9 is the same view as FIG. 7 taken during a different state of the program.

One state of the soft-key indicia is illustrated in FIG. 7, wherein soft-key indicia area 78*c* displays an upward-directed arrow and soft-key indicia 78*d* displays a downward-directed arrow. The associated keys (not shown in FIG. 7) provide scrolling of a cursor bar 82 on an image of possible selections superimposed over the bowler's score-sheet. If more selections are available than conveniently fit within the display area 84, the list of potential selections will scroll upward or downward when cursor bar 82 reaches, respectively, the downwardmost or upwardmost position as illustrated in FIG. 7. It is also noted by reference to FIG. 7 that indicia areas 78*b*, 78*e*, and 78*f* are blank. There is no function assigned to the keys associated with such indicia areas. Accordingly, the display is blank for these keys. Indicia areas 78*a*, 78*g*, and 78*h* are associated with keys that perform the same function for most of the states of the program as will be described in more detail below. As such, the indicia associated with the keys remain in their same locations for all such program states. FIG. 8 is similar to FIG. 7 except that the program is in a different state. However, the soft-keys are assigned the same functions and indicia as in FIG. 7 but for a different purpose; namely, selecting the scorer display format rather than the display language. FIG. 9 illustrates a different program state, which provides an on-screen calculator for use by the bowlers. Display areas 78*b*–78*g* display indicia related to calculator functions. The keys (not shown in FIG. 9) associated with these indicia areas carry out the functions illustrated within the respective indicia areas.

Figure 10A:
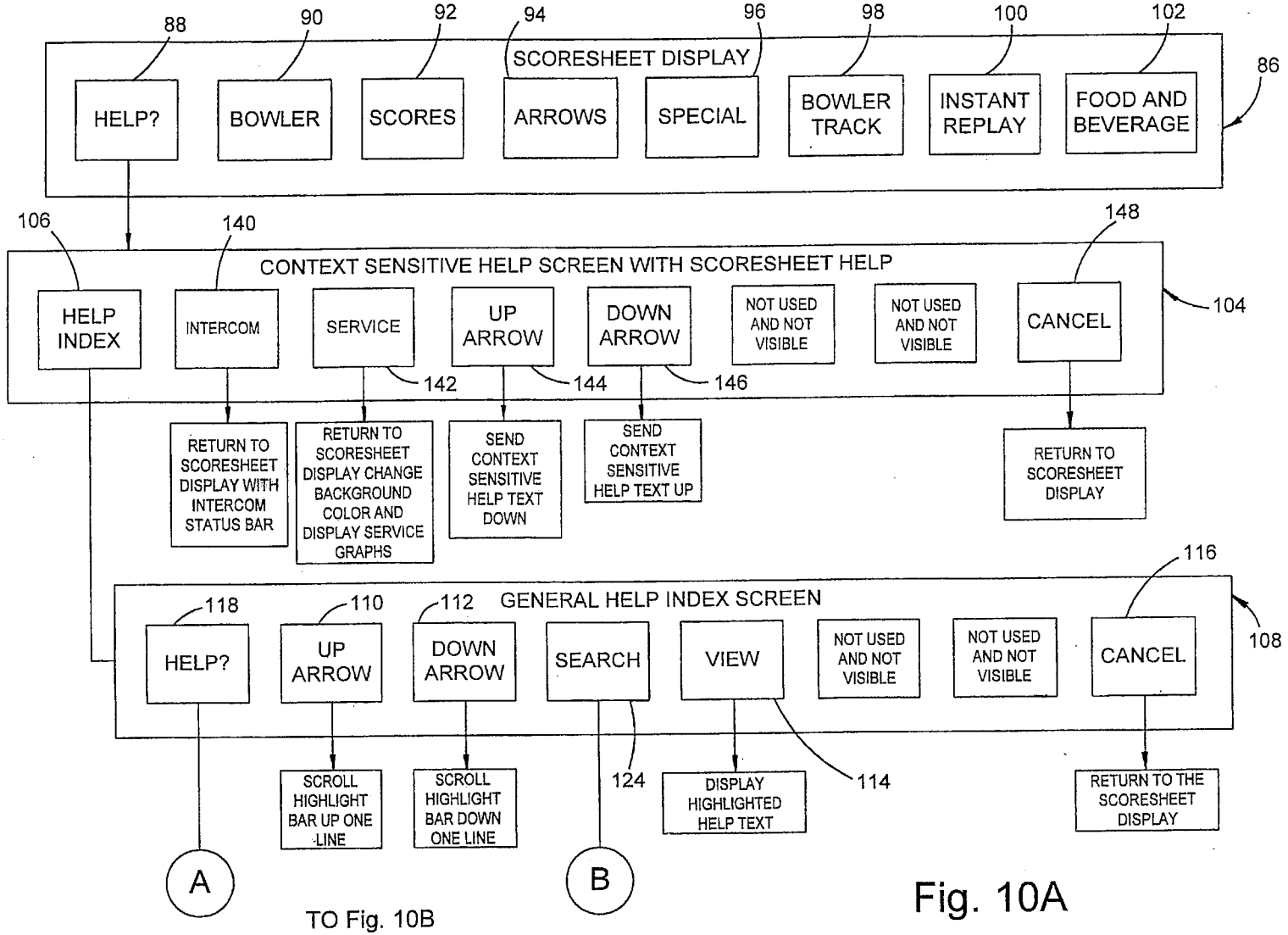
FIGS. 10A and 10B are a diagram of the input structure for the "help" function.
Figure 10B:
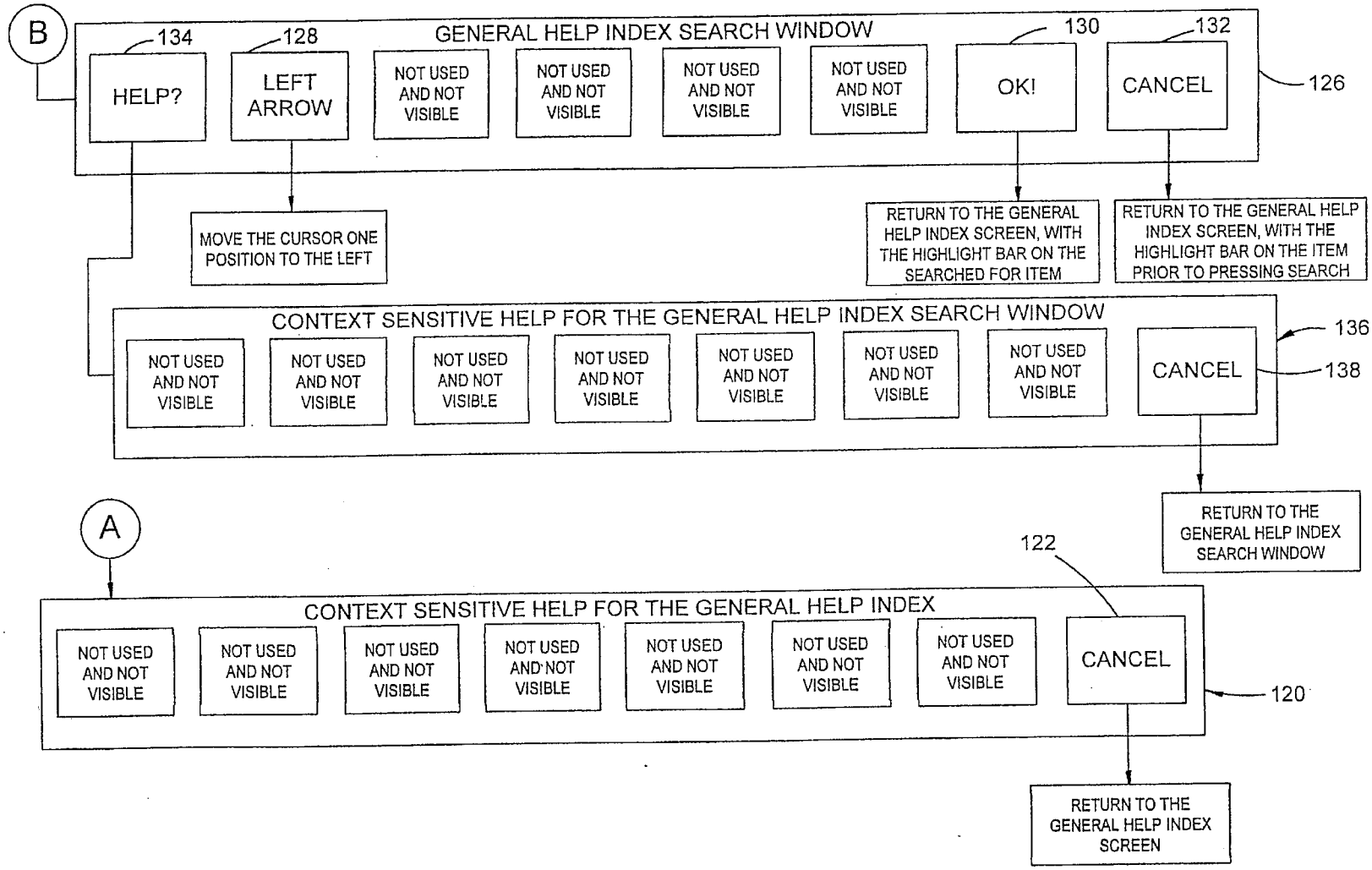

The soft-key routine 80 performs eight main functions illustrated in a main score-sheet display key-set 86, which is provided on display 28 unless a specific soft-key function is being entered. Key-set 86 includes function select keys for a contact sensitive help screen select key 88, an add/change bowler select key 90, a change score select key 92, a move arrows select key 94, a special features select key 96, a bowler track select key 98, an instant-replay select key 100, and a food and beverage select key 102 (FIGS. 10A, 11A, 12A, 13A, and 14A). When the user actuates the help select key 88, a context sensitive help screen key-set 104 is displayed by indicia areas 78*a*–78*h* (FIGS. 10A and 10B). Key-set 104 includes a help index key 106, which, when actuated, provides a key-set 108 and displays on the display 28 a group of selectible items. Within key-set 108, an up arrow select key 110 and a down arrow select key 112 provide scrolling of a highlight bar on the display. A view key 114 allows the user to view details of the item highlighted by the highlight bar. A cancel key 116 allows return to the main key-set 86. When in key-set 108, actuation of a help key 118 selects a key-set 120, which is blank except for a cancel key 122 which returns the user to the key-set 104. When in key-set 108, actuation of a search key 124 calls up a key-set 126 including a left arrow key 128, which, when actuated by the user, moves the cursor to the left. An OK select key 130 returns to the help index screen and selects the item highlighted by the highlight bar. A cancel button 132 returns to the help index key-set 108. When in the general help index search window key-set 126, actuation of a help key 134 provides a key-set 136, which includes a cancel key 138, which returns to the help index search key-set 126.

Context sensitive help screen key-set 104 additionally includes a key 140, which indicates to one or more front desks (not shown in FIG. 10A) that two-way intercom communication is desired. Actuation of a service key 142 indicates that service is requested by changing the background color of display 28. An up arrow key 144 and a down arrow key 146 scroll a highlight bar in opposite directions among a group of possible selections displayed on display 28.

Figure 11A:
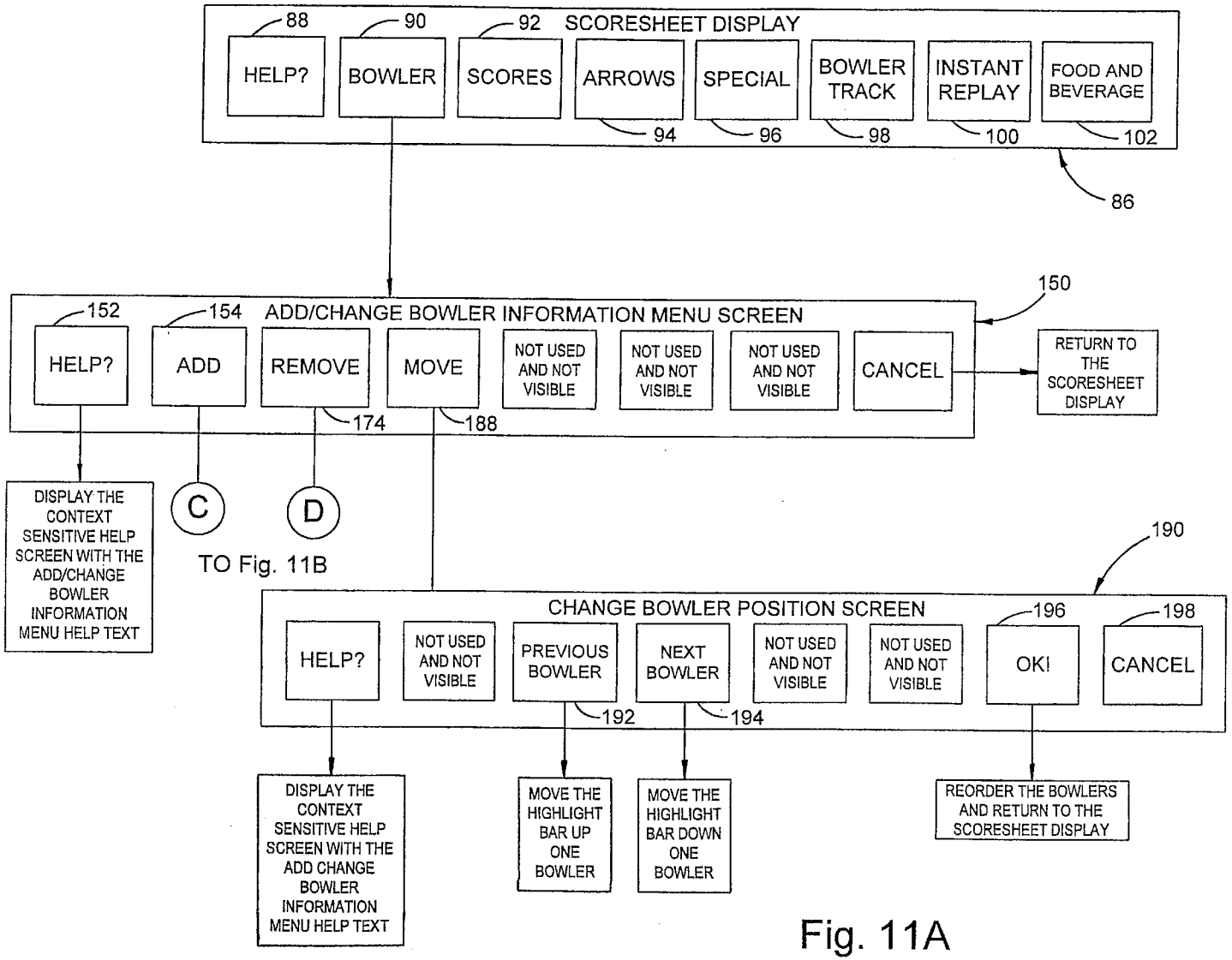
FIGS. 11A and 11B are a diagram of the input structure for the "bowler" function.
Figure 11B:
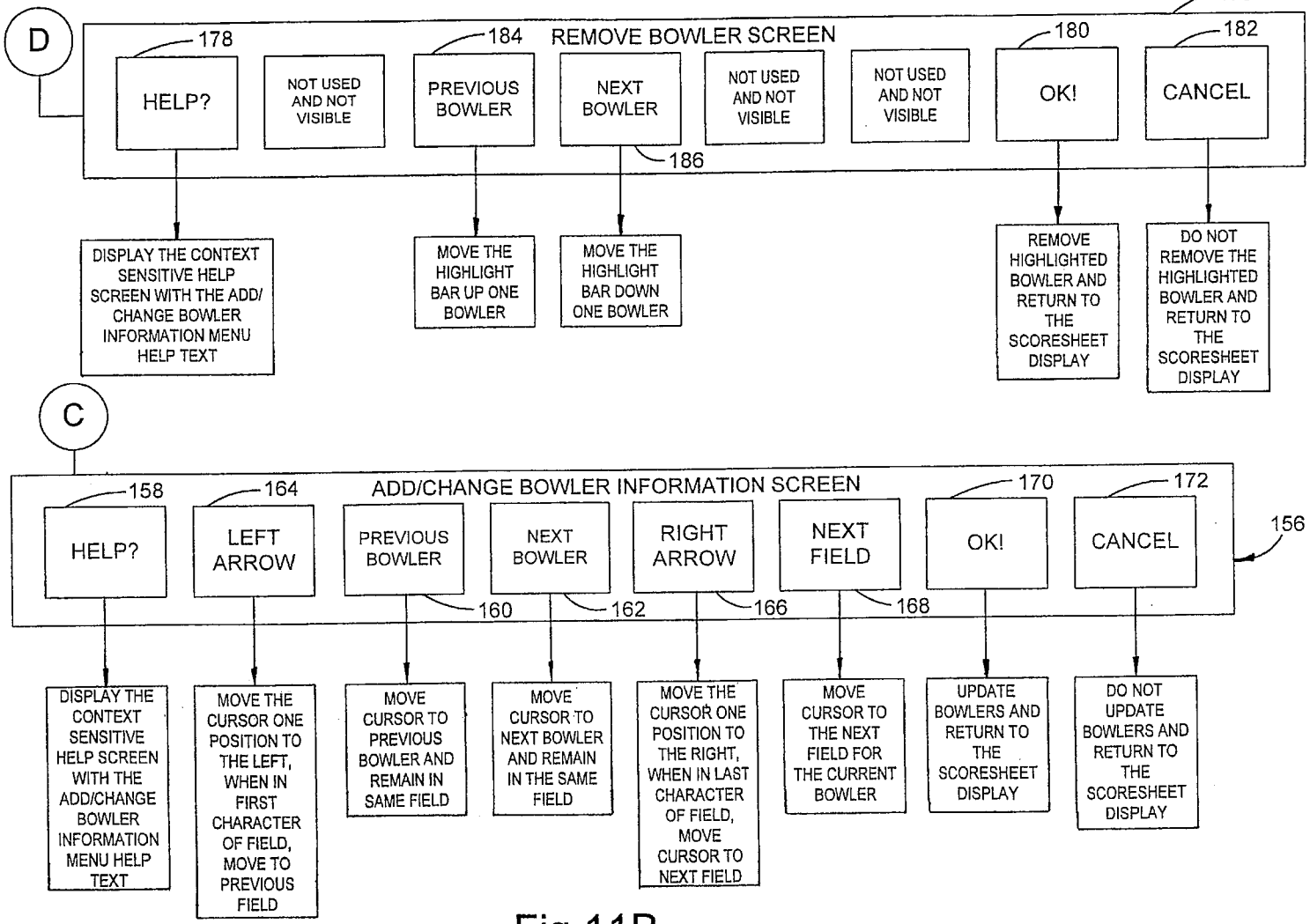

When a user selects bowler key 90 from the main score-sheet display key-set 86, an add/change bowler information key-set 150 is displayed in indicia areas 78*a*–78*h* (FIGS. 11A and 11B). Key-set 150 includes a help key 152, which, when selected, causes display of context sensitive help key-set 104 which was previously described. Key-set 150 includes an add key 154, which, when activated, causes display of an add/change bowler key-set 156 (FIG. 11B). In addition to a help key 158, which provides access to context sensitive help key-set 104, key-set 156 includes a previous bowler key 160 and a next bowler key 162, which moves a cursor to the previous or next bowler displayed on display device 28. A left arrow key 164 and a right arrow key 166 allow movement of the cursor, respectively, left or right. A next field key 168 advances the cursor to the next field for the current bowler. An OK key 170, when selected, updates the bowler file and returns to main score-sheet display key-set 86. A cancel key 172 returns to the score-sheet display key-set 86 without updating the bowler's file.

Add/change bowler information key-set 150 includes a remove key 174, which, when actuated, causes display of a remove bowler key-set 176. In addition to a help key 178, an OK key 180, and a cancel key 182, which function in a fashion analogous to those previously described, remove bowler key-set 176 includes a previous bowler key 184 for moving the cursor to the previous bowler from that bowler highlighted on the display and a next bowler key 186, which moves the cursor to the next bowler.

Add/change bowler key-set 150 additionally includes a move key 188, which, when actuated, causes display of a change bowler position key-set 190. Change bowler position key-set 190 includes a previous bowler key 192, which moves the highlighted bar up one bowler, and a next bowler key 194, which moves the highlight bar down one bowler. An OK key 196, when actuated, causes a reordering of the bowlers in the manner selected by keys 192 and 194 and return of the program to the score-sheet display key-set 86. A cancel key 198 causes direct returns to the score-sheet display 86.

Figure 12B:
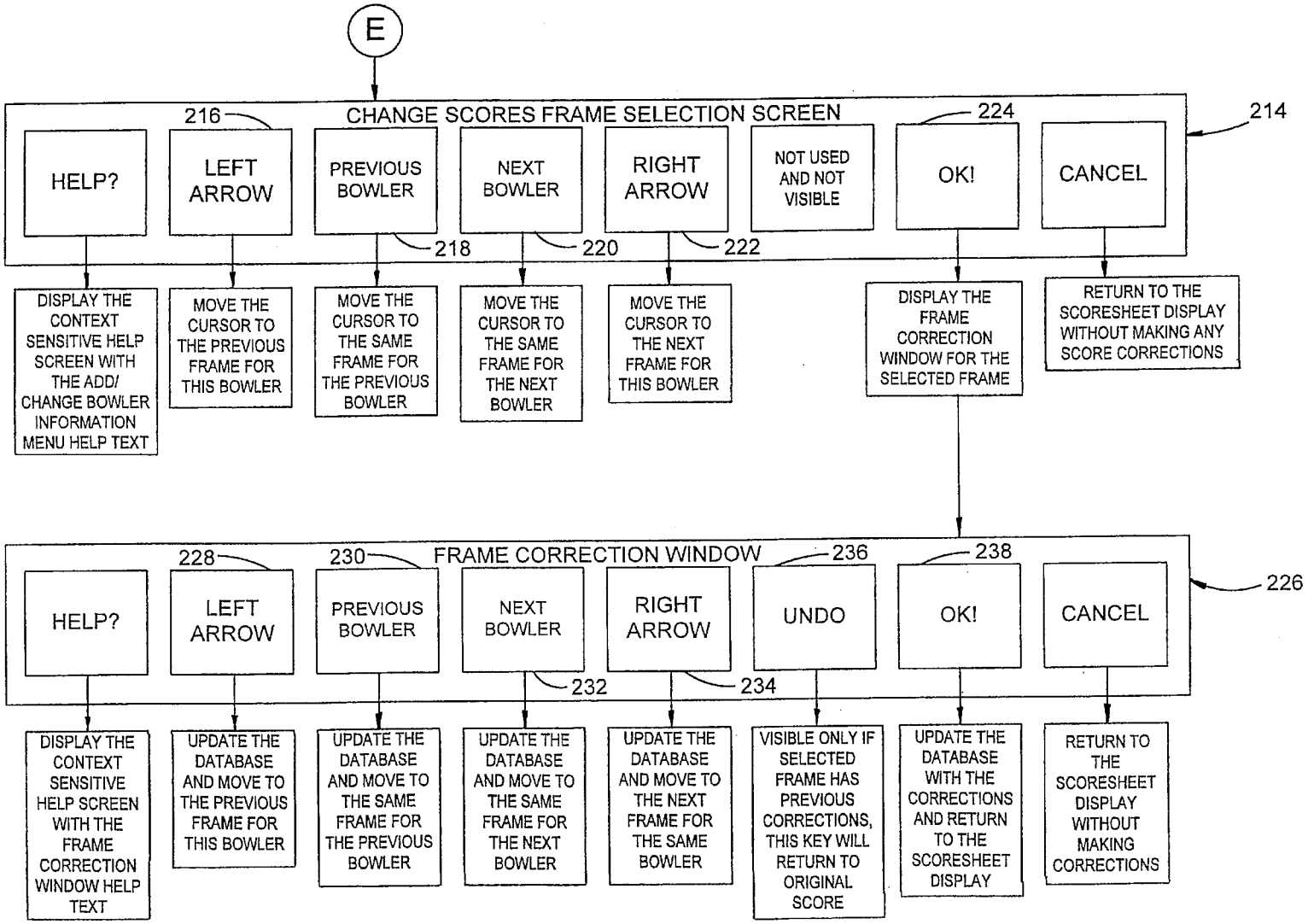
Figure 12C:
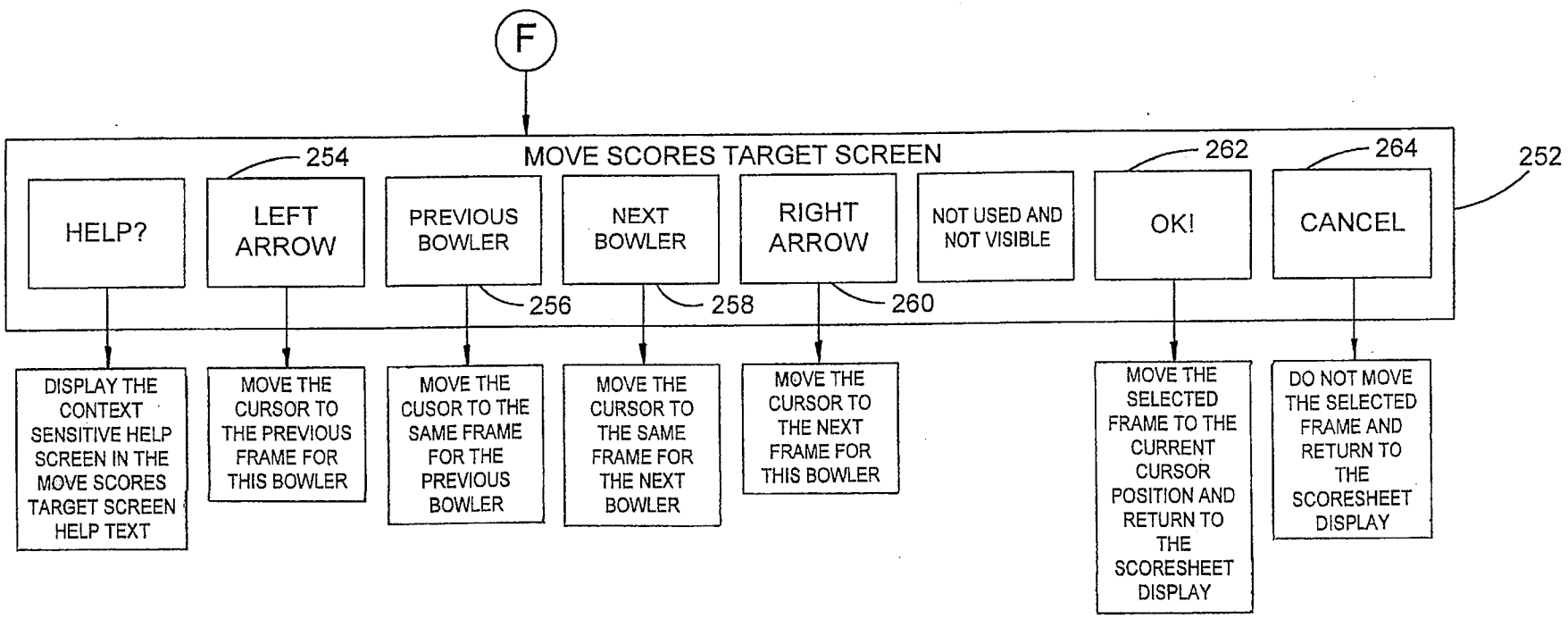

Scores key 92 on main score-sheet display key-set 86 causes a change scores key-set 202 to be displayed in indicia areas 78*a*–78*h* (FIGS. 12A–12C). The change score key-set includes a change score key 204, a move score key 206, and an erase score key 208. Key-set 202 additionally includes a help key 210 and a cancel key 212, which perform functions similar to those functions previously described. Change score key 204, when actuated, calls up a change scores frame key-set 214 (FIG. 12*b*). This key-set includes a left arrow key 216, a previous bowler key 218, a next bowler key 220, and a right arrow key 222, along with help, OK, and cancel keys. All of these keys perform functions similar to those previously described. However, the selection items displayed on display device 28 are related to changing a bowler's score for a particular frame. When an OK key 224 is actuated, upon the cursor being at the desired location on the displayed selection items, a frame correction key-set 226 is displayed. In addition to help, OK, and cancel keys, frame correction key-set 226 includes a left arrow key 228, a previous bowler key 230, a next bowler key 232, and a right arrow key 234, which moves a cursor among selection items displayed on display 28. An undue key 236 allows a previous correction to be returned to an original state while an OK key 238 carries out the selected correction.

Selection of move score key 206 calls up a move score key-set 240 (FIG. 12*a*). Key-set 240 includes a left arrow key 242, a previous bowler key 244, a next bowler key 246, and a right arrow key 248, which moves a cursor among selection items displayed on display 28 in a manner previously described. An OK selection key 250 in key-set 240 calls up a move scores key-set 252 in order to take action with respect to the selected item on the display (FIG. 12*c*). Move scores key-set 252 includes a left arrow key 254, a previous bowler key 256, a next bowler key 258, and a right arrow key 260 in order to allow the user to move the cursor among selection items displayed on display device 28. When the desired selection item is highlighted, actuation of an OK key 262 causes the highlighted score movement to be carried out. A cancel key 264 returns the program to the score-sheet display key-set 86.

Actuation of erase score key 208 calls up an erase-a-frame key-set 266, which includes a left arrow key 268, a previous bowler key 270, a next bowler key 272, and a right arrow key 274, which performs functions previously described. An OK key 276 carries out the selection highlighted by the cursor by movement of keys 268–274 and advances the program to display the score-sheet display key-set 86. A cancel key 278 returns to the score-sheet display key-set without carrying out the highlighted action.

Figure 13A:
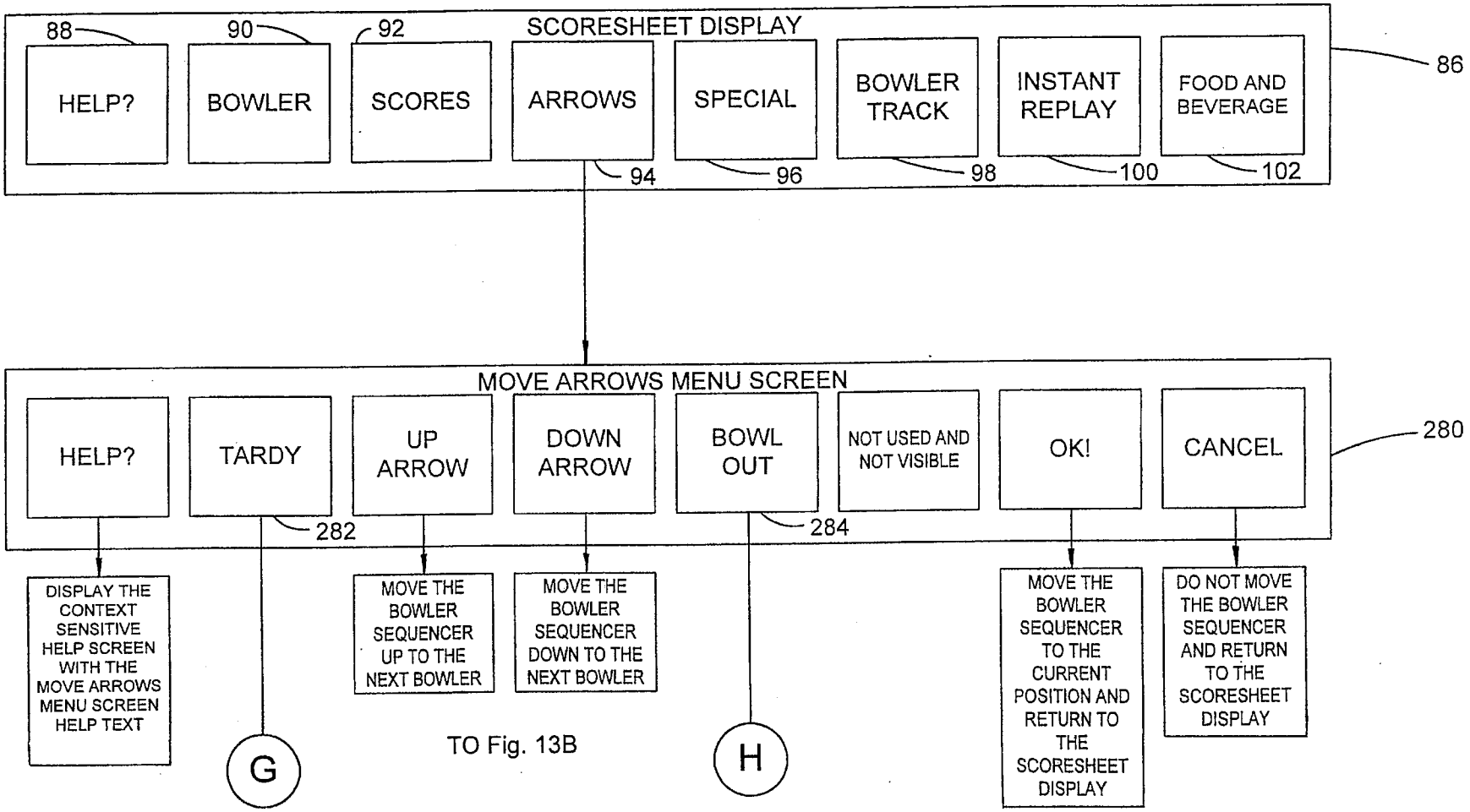
FIGS. 13A and 13B are a diagram of the input structure for the "arrows" function.
Figure 13B:
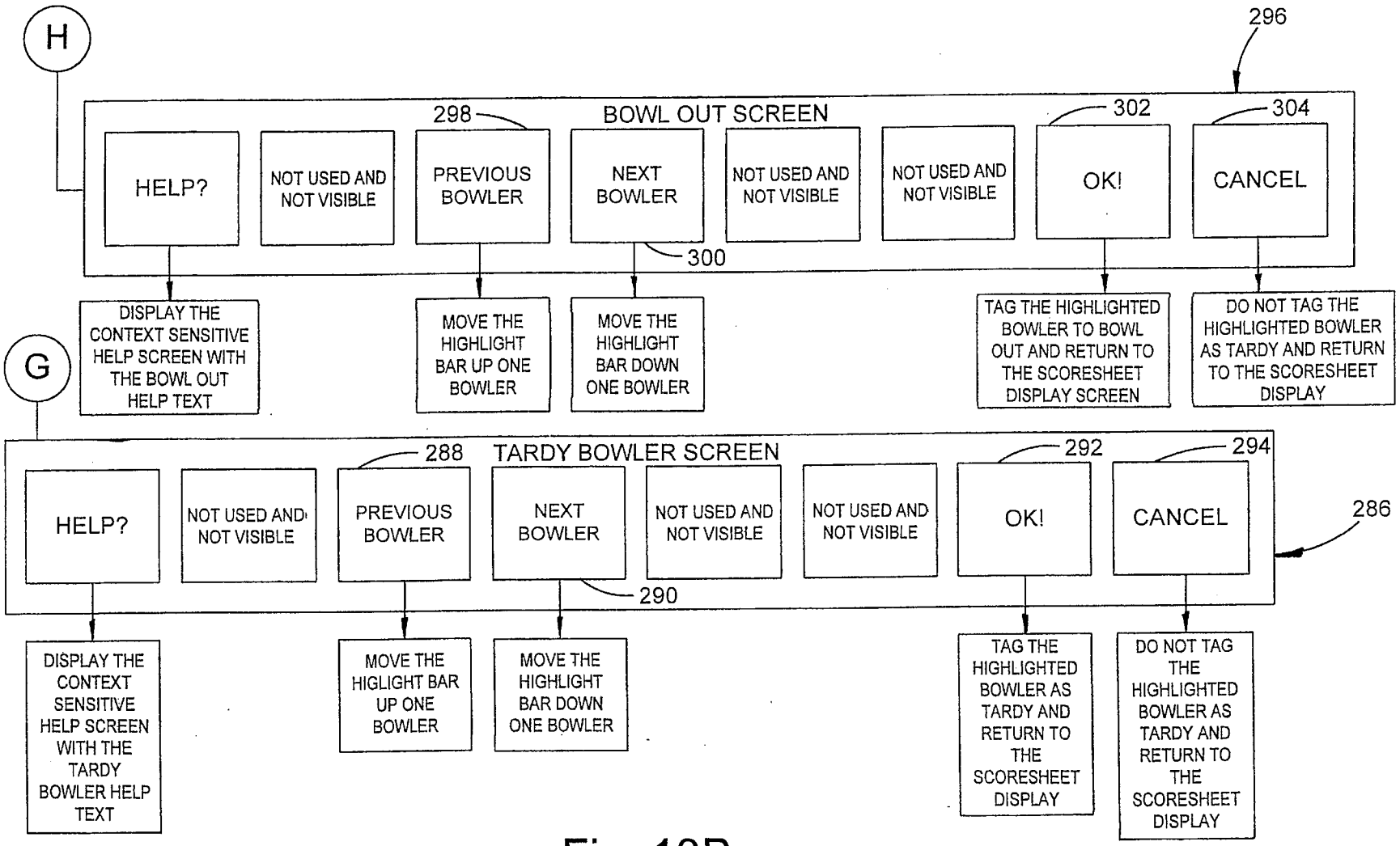
Figure 14A:
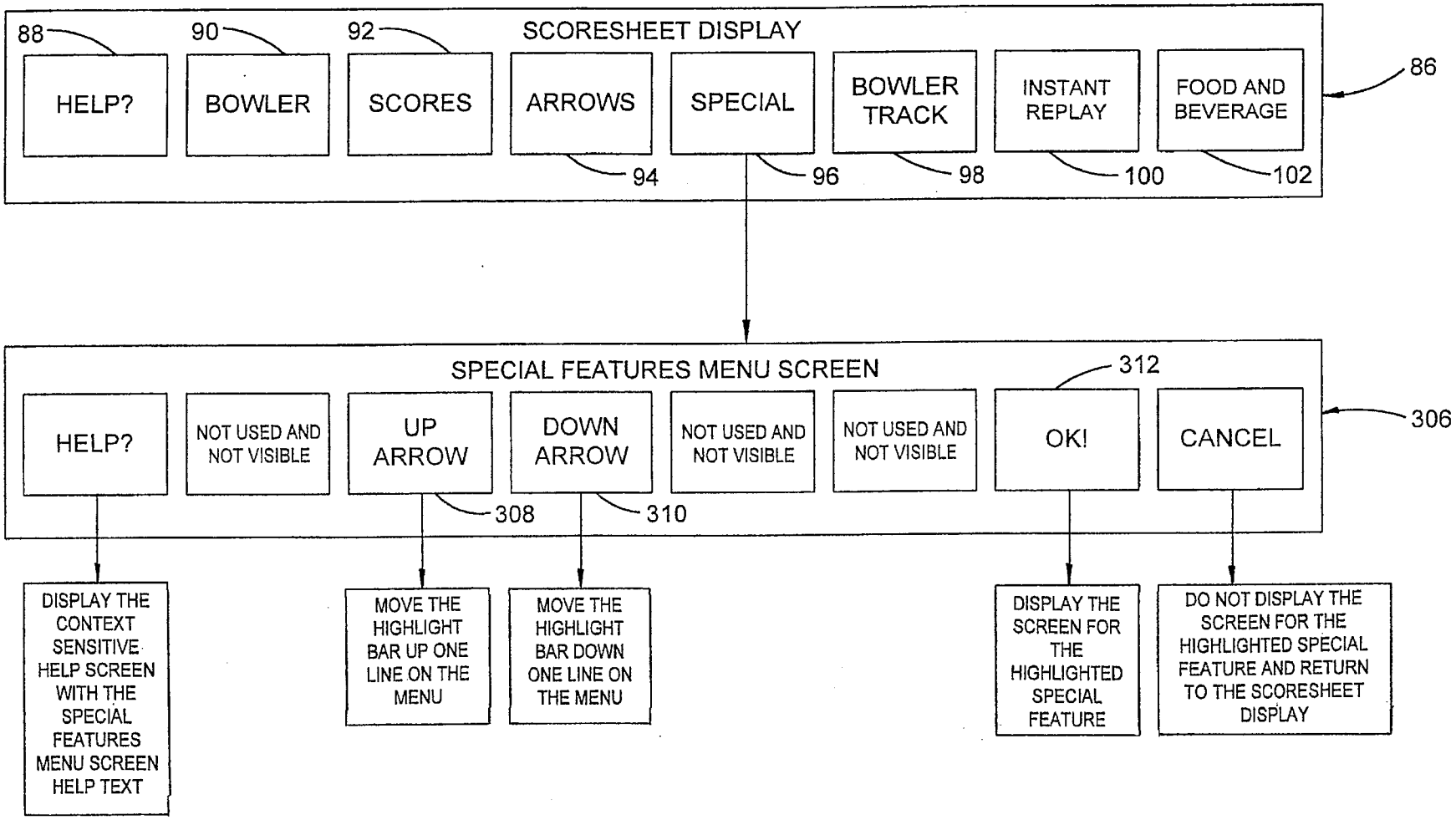
FIGS. 14A–14H are a diagram of the input structure for the "special features" function.
Figure 14B:
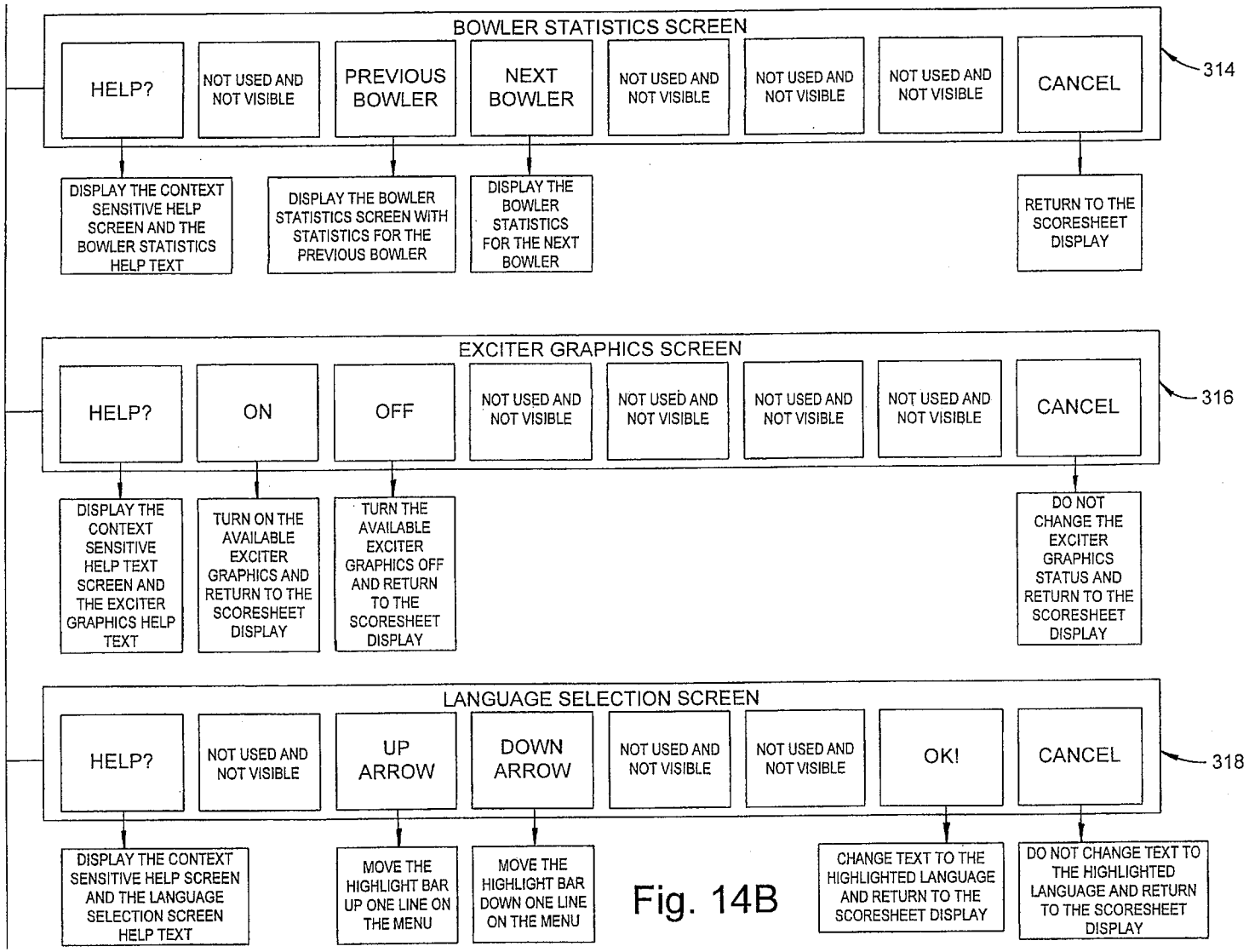
Figure 14C:
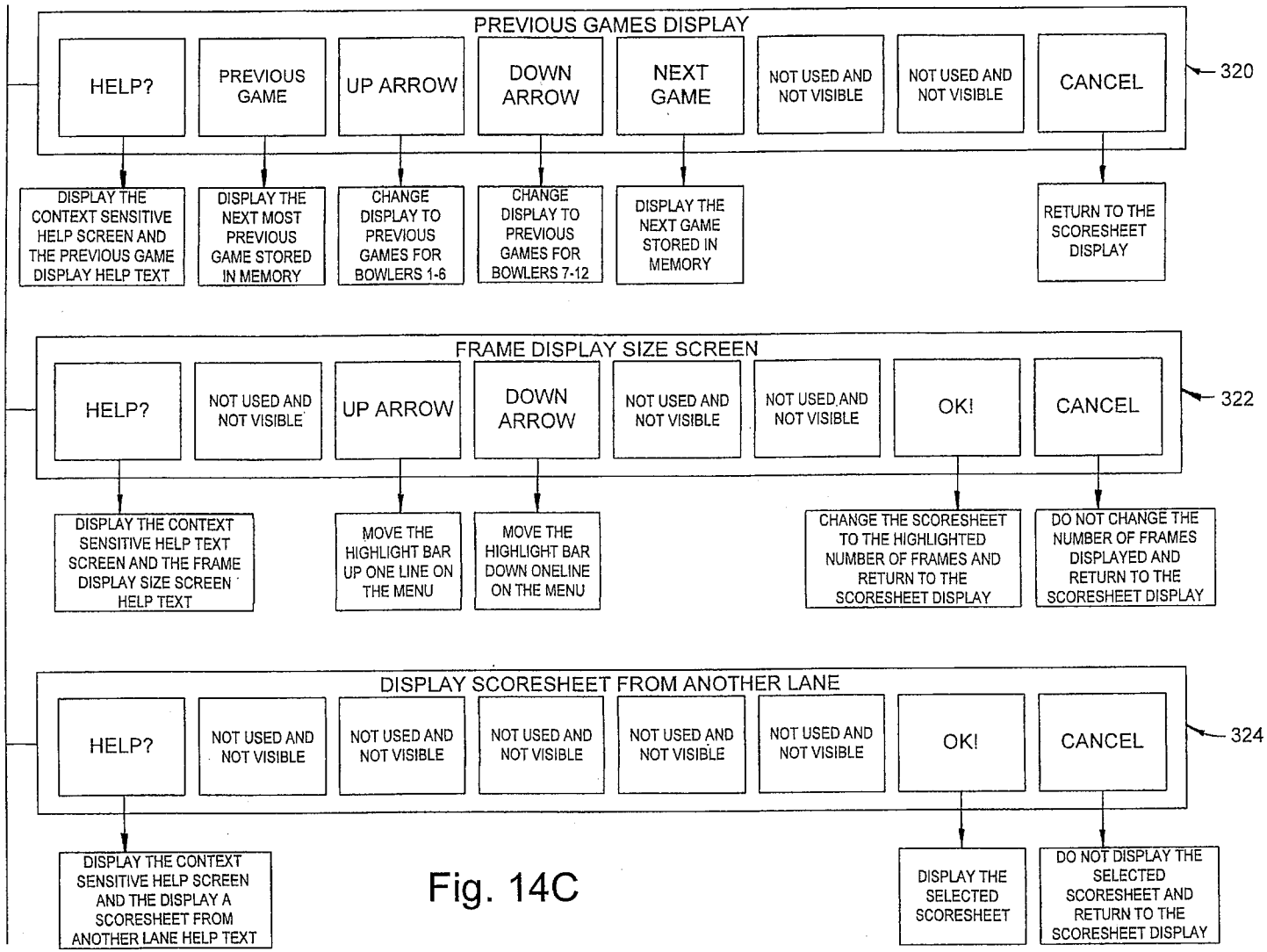
Figure 14D:
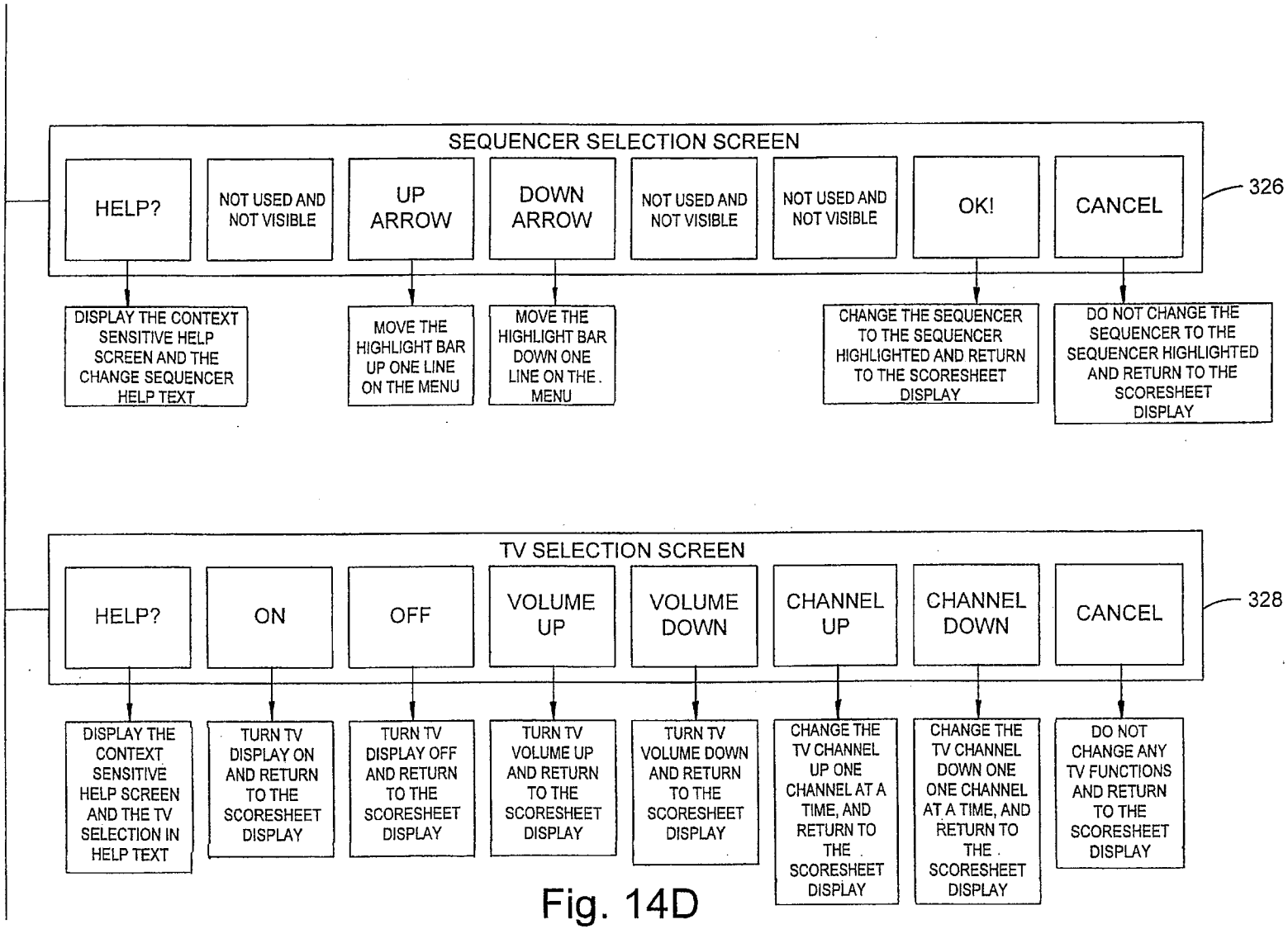
Figure 14E:
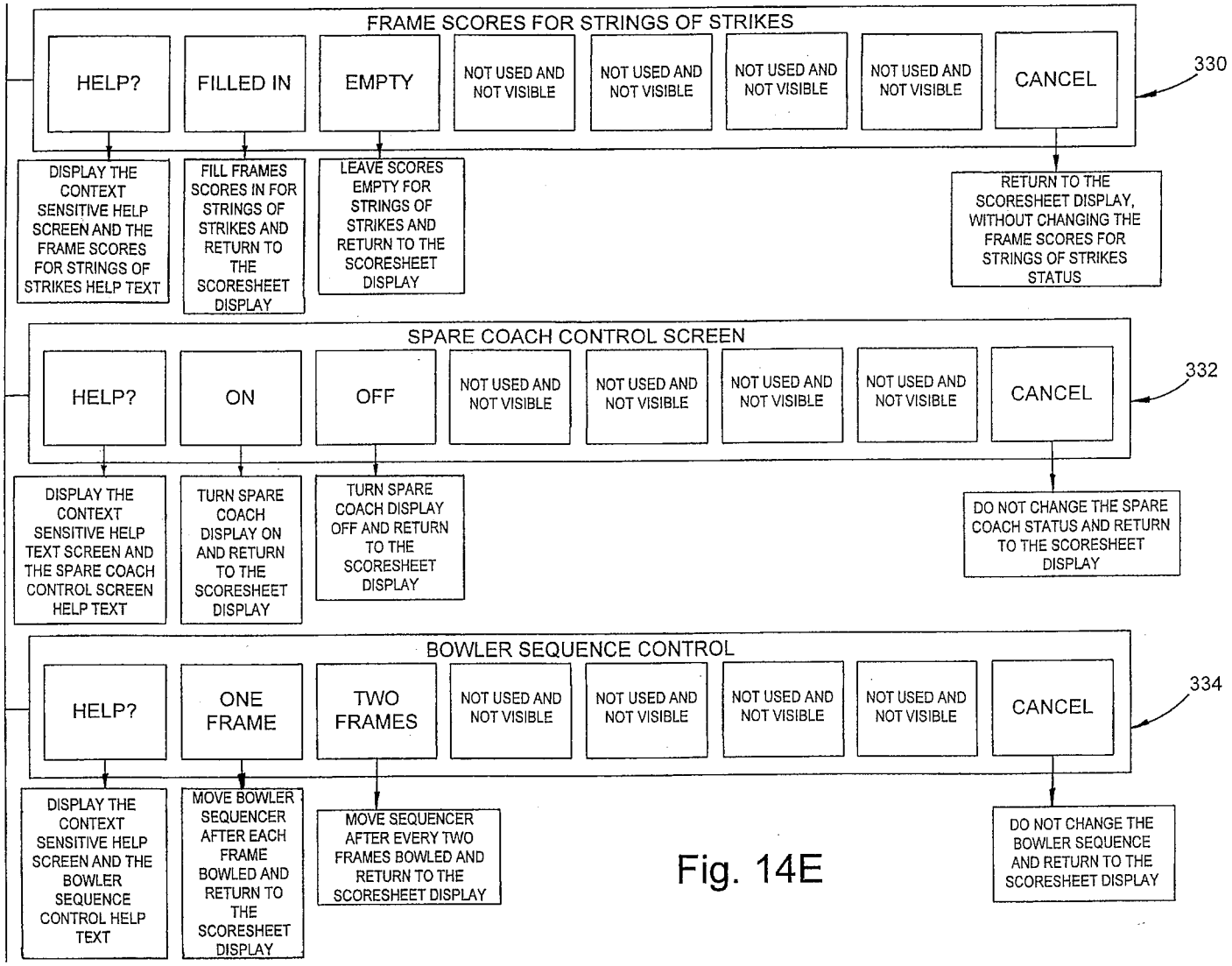
Figure 14F:
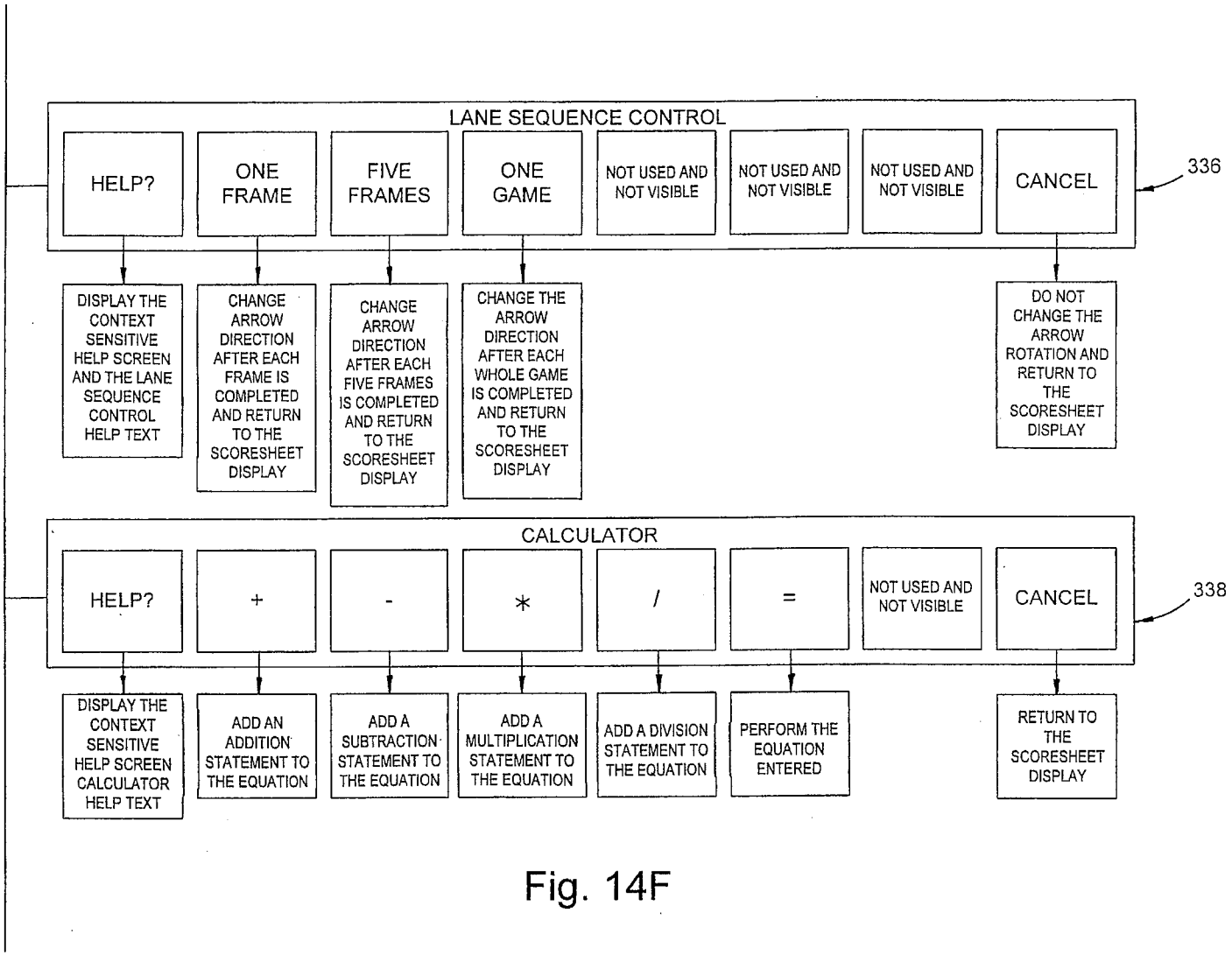
Figure 14G:
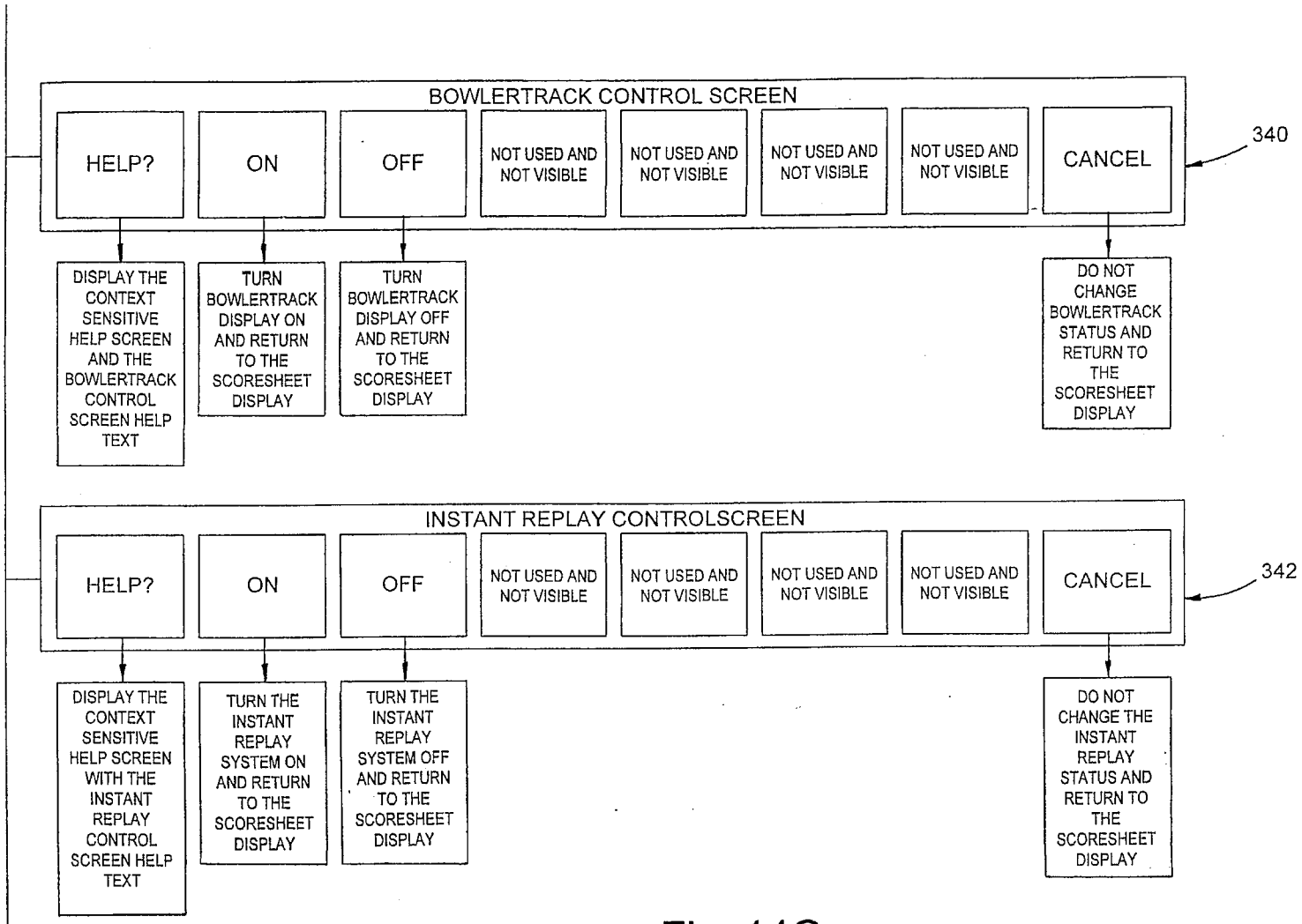
Figure 14H:
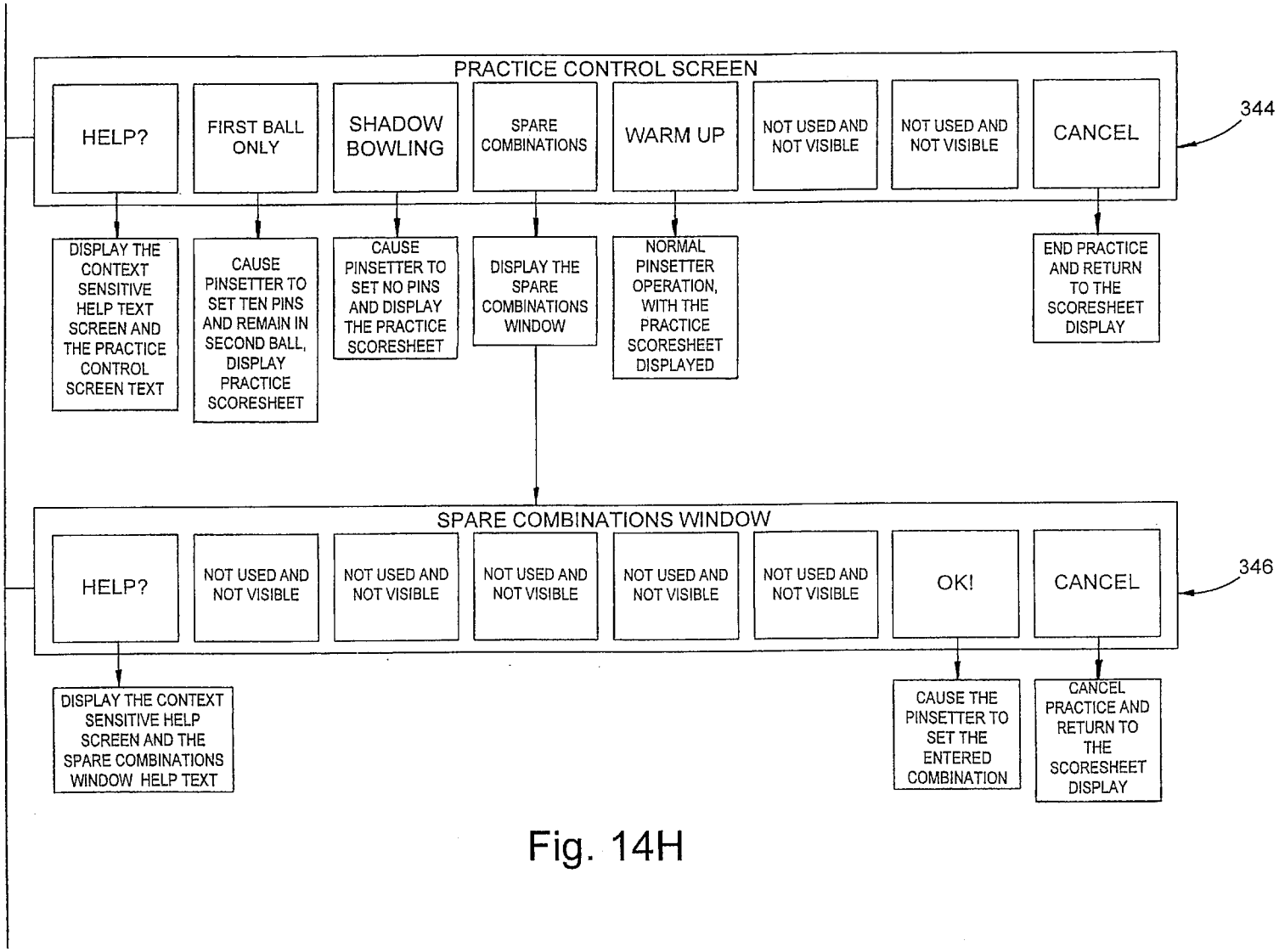

When the user selects the arrows key 94 from score-sheet display key-set 86, a moves arrow key-set 280 is called up and displayed on display 28 (FIGS. 13A and 13B). In addition to help, up arrow, down arrow, OK, and cancel keys, which function in a similar manner to that previously described, but on the selection items displayed on display 28, the move arrows key-set includes a tardy key 282 and a bowl-out key 284. When tardy key 282 is selected, a tardy key-set 286 is called up and displayed on display 28. The tardy bowler key-set 286 includes a previous bowler key 288 and a next bowler key 290, which moves the highlighted bar in opposite directions among the displayed bowlers. Selection of an OK key 292 causes the highlighted bowler to be tagged and to bowl out of sequence in a manner which will be described. A cancel key 292 causes return to the score-sheet display key-set 86 without any further action. Actuation of the bowl-out key 284 calls up a bowl-out key-set 296, which includes a previous bowler key 298 and a next bowler key 300 which moves the cursor bar in the manner previously described. An OK selection key 302 tags the highlighted bowler in order to bowl out of sequence in a manner which will be described. A cancel key 304 causes the program to return to the score-sheet display 86 without further action.

The tardy function allows a bowler be tagged as tardy, wherein the system will automatically weave that bowler into the line-up of bowlers so that the bowler may catch up without requiring the other bowlers to wait for that bowler to completely catch up. The bowl-out function automatically weaves the selected bowler in the line-up so that the bowler can quickly finish the game without requiring the other bowlers to wait. Both functions are carried out automatically once invoked by selection.

When special key 96 is selected from score-sheet display key-set 86, a special features key-set 306 is called up and displayed on display 28 (FIGS. 14A–14H). In addition to help, OK, and cancel keys, the special features key-set includes an up arrow key 308, and a down arrow key 310, which scrolls among various special feature selection items displayed on display 28. When the desired special selection function is highlighted by the prompting bar, actuation of the OK key 312 causes a key-set to be called up which provides selections relevant to the selected special feature. These include a bowler statistics key-set 314, which allows call-up and selection of statistics relevant to each of the bowlers, an exciter graphics key-set 316, which allows the user to turn the exciter graphics on or off, a language selection key-set 318, which allows the user to select the language for all screen displays and prompts, a previous games key-set 320, which provides selection keys in order to allow review of previous games bowled by the bowlers utilizing the goring console, a frames display key-set 322, which allows the user to select the number of frames displayed on the display 28, as illustrated in FIG. 8, a display score-sheet key-set 324, which allows review of a score-sheet from another lane, a sequence selection key-set 326, which changes the mode of operation of the sequencer, a TV selection key-set 328, which provides control for a television program displayed on display 28 or overhead monitor 26, a frame scores for strings of strikes 330, which allows selection of the number of frames in which sequential strikes are considered a string, a spare Coach control key-set 332, which allows the user to turn on or off the Coach feature, which will be described below, a bowler sequence key-set 334, which allows a sequence of one frame or two frames to be selected, a lane sequence key-set 336, which controls the lane arrow for matches utilizing a pair of lanes, a calculator key-set 338 for providing a calculator for use by the bowler, as illustrated in FIG. 9, a bowler track control screen 340, which allows a display of the bowler's previous rolled ball to be turned on or off, an instant-replay key-set 342, which allows an instant replay of the bowler's body movement during the previous ball to be turned on or off, a practice control screen 344, which allows the bowler to select various practice formats, and a spare combination key-set 346, which allows the practice mode selected by key-set 344 to be cancelled.

Automatic scoring system 20 additionally has a vacant bowler function that automatically compensates for teams with vacancies without requiring manipulation by the user. The scoring system additionally includes a pre-bowler function which allows a bowler and/or a team to pre-bowl scores for any week of the season. The scores are then automatically selected in the interfaced week of bowling or may be removed if the league or team decides that pre-bowled scores should not be used. Pre-bowled scores are automatically downloaded to the scorer console on the proper bowling night. For leagues that use the sum of individual handicaps, the handicap used on the night for pre-bowls will be placed on the handicapped used at the time the pre-bowl occurred. For leagues that use the sum of of individual handicaps, the handicap will be based upon the previous week's average. The automatic scoring system additionally will automatically compute the correct handicap when a mid-game substitution has occurred. This eliminates the risk of bowler error due to the complex calculation that is used to determine handicap according to conventional rules. The system will also compute the correct absentee score to use if a bowler cannot finish a game. The automatic scoring system 20 additionally includes a bowler personal identification number, which eliminates the need to manually enter substitute bowler information at the scorer console.

Figure 15:
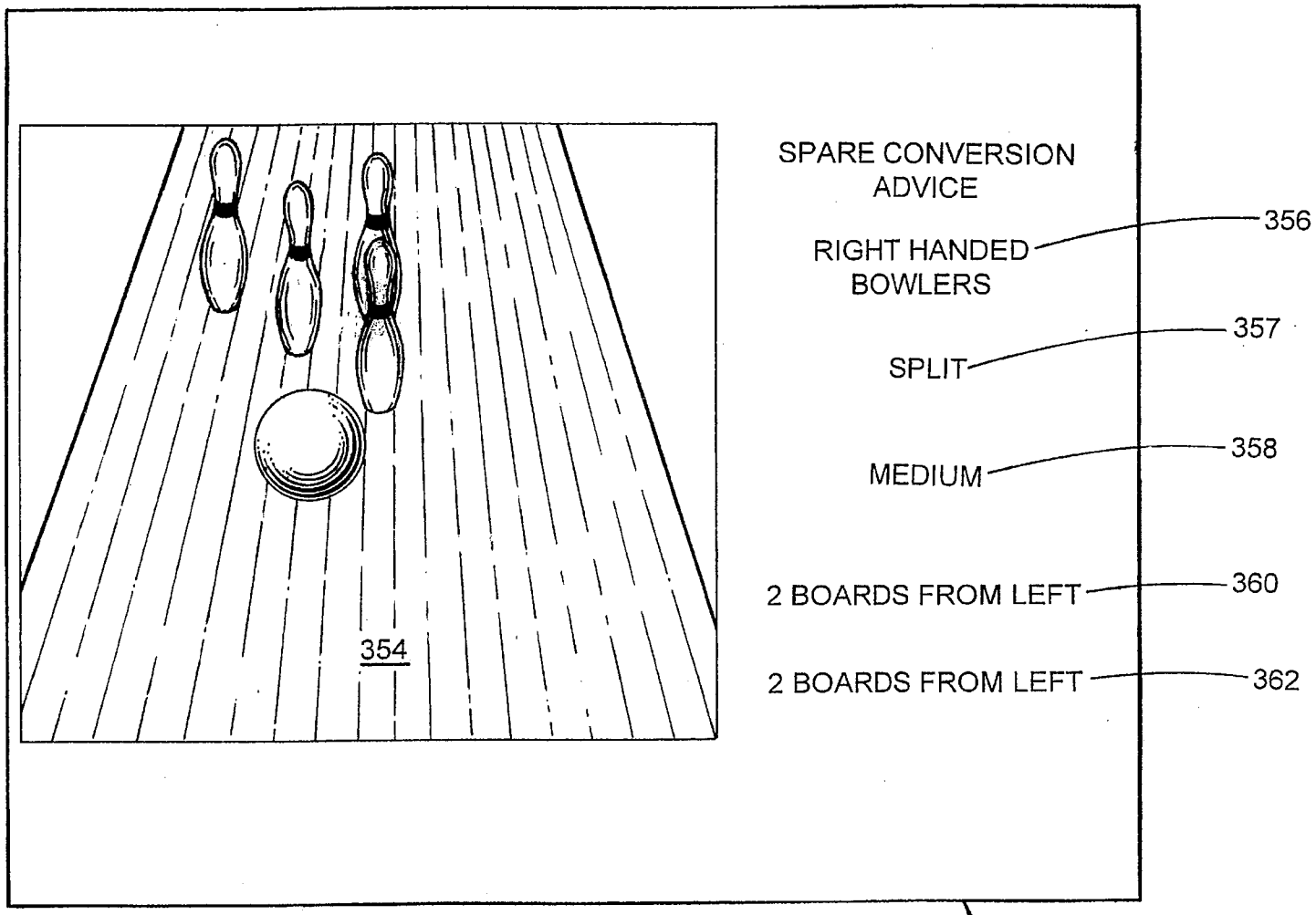
FIG. 15 is a graphic display of a bowler coaching device, according to the invention.

Automatic scoring system 20 additionally includes a bowler coaching device, generally designated 350, for advising a bowler of a strategy for converting a leave. Coaching device 350 responds to the output of a pin-fall sensor (not shown), which determines the pattern of pins standing after a bowler rolls a first ball. Bowler coaching device 350 includes a database of 1,023 possible patterns of pins standing after a first ball and including information relevant to each such leave. The information incorporated into each entry in the database is whether each pattern is considered a split and whether the spare is considered a low degree of difficulty, a moderate degree of difficulty, or a high degree of difficulty. The database additionally includes information regarding the placement of the target, or the position of the mid-lane, where the ball should pass. This value is measured in boards, the bowler should move the target from the previously delivered ball. Each of the records in the database additionally includes the placement of the feet, or position that the bowler should start the approach, which is also described in boards with respect to that of the initial delivery. The database additionally includes an entry of the contact area where the ball should contact the pin. The above-described information for each entry in the database is replicated for both left-handed and right-handed bowlers. A graphic display generally indicated at 352 is shown on display 28 and/or on overhead monitor 26 automatically after the bowler has rolled the first ball of a frame unless the feature is turned off (FIG. 15). The interface includes a graphic illustration area at 354 of an image of the pattern of pins standing and a ball in the contact area. The interface additionally includes a field 356, which indicates whether the particular bowler is a right-handed bowler or a left-handed bowler, a field 357, which indicates if the leave is considered a split display field 358, which indicates the degree of difficulty of the conversion, a display field 360, which displays the number of boards to be moved for placement of the target position, and a field 362 for displaying from the database the board movement for feet placement of the bowler.

Figure 16:
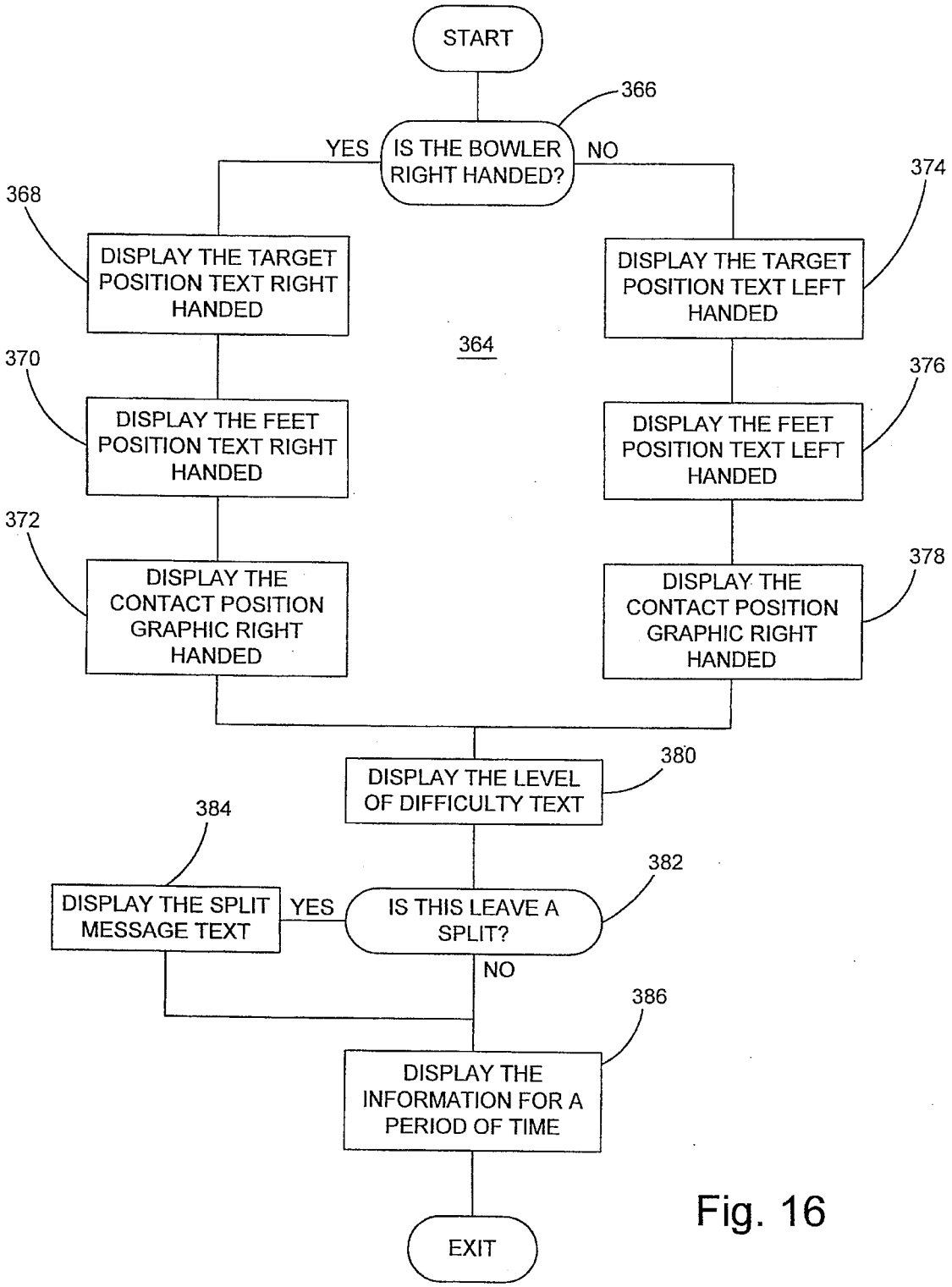
FIG. 16 is a flowchart of the bowler coaching device illustrated in FIG. 15.

The information displayed on graphic display 352 is generated by a display program 364 (FIG. 16). After the micro-controller 48 has retrieved the database entry corresponding to the pattern of pins left standing after the bowler rolls the first ball, the routine determines at 366, from information previously entered by the bowler in the scoring console, whether the bowler is a right-handed bowler. If the bowler is a right-handed bowler, the controller displays at 368, in field 360, the target position text in the database record for right-handed bowlers. The control then displays at 370, in field 362, the feet position for right-handed bowlers. The control displays at 372, in display 354, the graphic image relevant to a ball rolled by a right-handed bowler. If it is determined at 366 that the bowler is not a right-handed bowler, then the bowler is a left-handed bowler. The control then displays at 374, in field 360, the target position for a left-handed bowler and displays at 376, in field 362, the feet position for a left-handed bowler. The control displays at 378, in display area 354, a graphic image of the area of where a ball should be delivered in order to place the ball in the contact area.

The control then displays at 380, in field 358, the level of difficulty text from the selected file. It is then determined at 382, from the entry in the database file, whether the leave is considered a split. If so, it is displayed at 384, in a field 357, that the pattern is a split. If not, no entry is made in field 357. The display in graphic user interface 352 is held at 386 for a predetermined period of time, which may be adjusted by the user. As previously mentioned, the entire bowler coaching device 350 may be disabled by the users.

Changes and modifications in the specifically described embodiments can be carried out without departing from the principles of the invention, which is intended to be limited only by the scope of the appended claims, as interpreted according to the principles of patent law including the doctrine of equivalents.

The embodiments of the invention in which an exclusive property or privilege is claimed are defined as follows:

1. A bowling scoring system user input selection device for receiving user input selections, said bowling scoring system being responsive to a pin-fall sensor for computing bowler's scores and including a display device for displaying said scores, comprising:

a controller including a program having various program states, said controller responsive to the state of said program for performing a particular one of a plurality of functions;

a plurality of input selection keys juxtaposed with said display device for providing inputs to said controller;

a plurality of softkey indicia areas on said display device, each of said softkey indicia areas associated with one of said input selection keys; and said controller responsive to the state of said program for displaying a particular label in at least one of said softkey indicia areas and for performing a function associated with the displayed label in response to actuation of the one of said input selection keys associated with the labeled softkey indicia area, said controller displays on said display device a plurality of available choices for selection by the user in particular states of said program, wherein said one of said input selection keys associated with the labeled softkey indicia area provides a selection means for selecting one of said choices, wherein said controller includes scrolling means scrolling the available choices displayed on said display device and wherein said selection means controls said scrolling means, and wherein said selection means includes first and second input selection keys, each associated with one of said labeled softkey indicia areas, said first input selection key for causing scrolling in one direction and said second input selection key for causing scrolling in an opposite direction.

2. The bowling scoring system user input selection device in claim 1 wherein said plurality of input selection keys are on a keypad separate from said display device.

3. The bowling scoring system user input selection device in claim 1 wherein said plurality of input selection keys are defined by a touch-screen key actuation system which responds to user proximity to particular areas of said display device for receiving user input selections.

4. The bowling scoring system user input selection device in claim 3 wherein said input selection keys and said softkey indicia areas are distributed across the bottom of said display device.

5. The bowling scoring system user input selection device in claim 1 wherein said controller does not display a label in a particular softkey indicia area for a particular state of said program not having a function to be performed in response to actuation of the associated input selection key.

6. A method of receiving user input selections in a bowling scoring system that is responsive to a pin-fall sensor for computing bowler's scores and including a display device for displaying said scores, including:

providing a controller including a program having various program states, said controller responsive to the state of said program for performing a particular one of a plurality of functions;

providing a plurality of input selection keys juxtaposed with said display device for providing inputs to said controller;

providing a plurality of softkey indicia areas displayed on a predetermined portion of said display device, each of said softkey indicia areas having a fixed and unchanging location on said display and having a unique association with one of said input selection keys, said predetermined portion of said display being adjacent to an area of said display in which said scores are displayed such that said softkey indicia areas and said scores are displayed simultaneously;

displaying a particular label in at least one of said softkey indicia areas as a function of the state of said program and performing a function associated with the displayed label in response to actuation of the one of said input selection keys associated with the labeled softkey indicia area;

displaying on said display device a plurality of available choices for selection by the user in particular states of said program and providing said one of said input selection key associated with the labeled softkey indicia area as a selection means for selecting one of said choices; and displaying on said display device fewer than all of the available choices and scrolling the available choices displayed on said display device in response to actuation of said selection means, wherein said selection means includes first and second input selection keys, each associated with one of said lableled softkey indicia areas, and providing said first input selection key for causing scrolling in one direction and said second input selection key for causing scrolling in an opposite direction.

7. The method of receiving user input selections in a bowling scoring system in claim 6 including providing said plurality of input selection keys on a keypad separate from said display device.

8. The method of receiving user input selections in a bowling scoring system in claim 6 including not displaying a label in a particular softkey indicia area for a particular state of said program not having a function to be performed in response to actuation of the associated input selection key.

9. The method of receiving user input selections in a bowling scoring system in claim 6, including defining said plurality of input selection keys by a touch-screen key actuation system which responds to user proximity to particular areas of said display device for receiving user input selections.

10. The method of receiving user input selections in a bowling scoring system in claim 9 including distributing said input selection keys and said softkey indicia areas across the bottom of said display device.

11. A bowling scoring system comprising:

score calculation means responsive to a pin-fall sensor for calculating bowler's scores;

a display device coupled to said score calculation means for display said scores; and a bowler coaching device for a bowler of a strategy for converting a leave, said bowler coaching device including:

leave identification means responsive to said pin-fall sensor for determining an identity of a pattern of pins standing after a bowler rolls a first ball;

conversion analysis means responsive to said leave identification means for determining a contact area where a ball should contact the pattern of pins standing in order to convert the leave and for determining bowler actions required in order to place the ball in the contact area; and display generation means coupled to said display device and responsive to said conversion analysis means for causing said display device to display said contact area and said bowler actions required for the pattern of pins standing after the bowler rolls the first ball.

12. The bowling scoring system in claim 11 wherein said display generation means includes graphic generation means for generating an image of said pattern of pins and a ball in said contact area.

13. The bowling scoring system in claim 12 wherein said bowler actions include location of a target portion of the lane where the bowler should deliver the ball in order to place the ball in the contact area.

14. The bowling scoring system in claim 13 wherein said bowler actions include location of a placement of the bowler's feet at a start of the bowler's approach required to deliver the ball to said target portion.

15. The bowling scoring system in claim 14 including input means for receiving user selection of the hand used by the bowler to deliver the ball and wherein said conversion analysis means determines said location of said target portion of the lane and said location of a placement of the bowler's feet at least partially as a function of the user selection of the hand used by that bowler to deliver the ball.

16. The bowling scoring system in claim 15 wherein said conversion analysis means automatically determines a measure of difficulty of converting the pattern of pins standing and said display generation means causes said display device to display said measure.

17. The bowling scoring system in claim 15 wherein said conversion analysis means automatically determines whether the pattern of pins standing is considered a split and said display generation means causes said display device to display whether the pattern of pins standing is considered a split.

18. The bowling scoring system in claim 12 wherein said bowler actions include location of a target portion of the lane where the bowler should deliver the ball in order to place the ball in the contact area.

19. The bowling scoring system in claim 12 including input means for receiving user selection of the hand used by the bowler to deliver the ball and wherein said conversion analysis means determines said bowler's action required at least partially as a function of the user selection of the hand used by that bowler to deliver the ball.

20. The bowling scoring system in claim 12 and further including a scoring console having an input device for receiving user input for entry into the scoring system, said input device including a key for allowing a user to enable or disable said bowler coaching device for a specified lane.

21. The bowling scoring system in claim 12 and further including a scoring console having an input device for receiving user input for entry into the scoring system, said input device including a key for allowing a user to input whether a bowler is right or left handed.

22. The bowling scoring system in claim 12 and further including:

a scoring console having an input device for receiving user input for entry into the scoring system and a scoring console processor coupled to said input device, said display device for processing user inputs received from said input device; and a memory device coupled to said scoring console processor for storing a database of bowler actions required to convert a leave for every possible pattern of pins, wherein said conversion analysis means is implemented in said scoring console processor.

23. A bowling scoring system comprising:

score calculation means responsive to a pin-fall sensor for calculating bowlers' scores;

a display device coupled to said score calculation means for said scores; and a bowler coaching device for advising a bowler of a strategy for converting a leave, said bowler coaching device including:

leave identification means responsive to said pin-fall sensor for determining an identity of a pattern of pins standing after a bowler rolls a first ball;

conversion analysis means responsive to said leave identification means for determining a contact area where a ball should contact the pattern of pins standing in order to convert the leave and for determining bowler actions required in order to place the ball in the contact area, wherein said bowler actions include location of a placement of the bowler's feet at a start of the bowler's approach required to deliver the ball to said target portion; and display generation means responsive to said conversion analysis means for causing said display device to display said contact area and said bowler actions required for the pattern of pins standing after the bowler rolls the first ball.

24. A bowling scoring system comprising:

score calculation means responsive to a pin-fall sensor for calculating bowler's scores;

a display device coupled to said score calculation means for displaying said scores; and a bowler coaching device for advising a bowler of a strategy for converting a leave, said bowler coaching device including:

leave identification means responsive to said pin-fall sensor for determining an identity of a pattern of pins standing after a bowler rolls a first ball;

conversion analysis means responsive to said leave identification means for determining a contact area where a ball should contact the pattern of pins standing in order to convert the leave and for determining bowler actions required in order to place the ball in the contact area; and display generation means responsive to said conversion analysis means for causing said display device to display said contact area and said bowler actions required for the pattern of pins standing after the bowler rolls the first ball, wherein said conversion analysis means automatically determines a measure of difficulty of converting the pattern of pins standing and said display generation means causes said display device to display said measure.

25. A bowling scoring system comprising:

score calculation mean responsive to a pin-fall sensor for calculating bowler's score;

a display device couple to said score calculation means for displaying said scores; and a bowler coaching device for advising a bowler of a strategy for converting a leave, said bowler coaching device including:

leave identification means responsive to said pin-fall sensor for determining an identity of a pattern of pins standing after a bowler rolls a first ball;

conversion analysis means responsive to said leave identification means for determining a contact area where a ball should contact the pattern of pins standing in order to convert the leave and for determining bowler actions required in order to place the ball in the contact area; and display generation means responsive to said conversion analysis means for causing said display device to display said contact area and said bowler actions required for the pattern of pins standing after the bowler rolls the first ball, wherein said conversion analysis means automatically determines whether the pattern of pins standing is considered a split and said display generation means causes said display device to display whether the pattern of pins standing is considered a split.

26. A method of advising a bowler of a strategy for converting a leave in a bowling scoring system that is responsive to a pin-fall sensor for computing bowlers' scores and including a display device for displaying said scores, comprising:

determining from said pin-fall sensor an identity of a pattern of pins standing after a bowler rolls a first ball;

determining from the pattern of pins standing a contact area where a ball should contact the pattern of pins standing in order to convert the leave and the bowler's action required in order to place the ball in the contact area; and displaying on said display device said contact area and said bowler's actions required for converting the pins standing after the bowler rolls the first ball.

27. The method of advising a bowler of a strategy for converting a leave in a bowling scoring system in claim 26 wherein said displaying includes generating an image of said pattern of pins and a ball in said contact area.

28. The method of advising a bowler of a strategy for converting a leave in a bowling scoring system in claim 26 wherein bowler actions include location of a target portion of the lane where the bowler should deliver the ball in order to place the ball in the contact area.

29. The method of advising a bowler of a strategy for converting a leave in a bowling scoring system in claim 28 wherein said bowler actions include location of a placement of the bowler's feet at a the start of the bowler's approach required to deliver the ball to said target portion.

30. The method of advising a bowler of a strategy for converting a leave in a bowling scoring system in claim 29 including receiving user selection of the hand used by the bowler to deliver the ball and wherein said determining the bowler's actions includes determining said location of said target portion of the lane and said location of a placement of the bowler's feet at least partially as a function of the user selection of the hand used by that bowler to deliver the ball.

31. The method of advising a bowler of a strategy for converting a leave in a bowling scoring system in claim 30 including automatically determining a measure of difficulty of converting the pattern of pins standing and displaying said measure on said display device.

32. The method of advising a bowler of a strategy for converting a leave in a bowling scoring system in claim 30 including automatically determining whether the pattern of pins standing is considered a split and displaying on said display device whether the pattern of pins standing is considered a split.

33. The method of advising a bowler of a strategy for converting a leave in a bowling scoring system in claim 26 wherein said bowler actions include location of a target portion of the lane where the bowler should deliver the ball in order to place the ball in the contact area.

34. The method of advising a bowler of a strategy for converting a leave in a bowling scoring system in claim 26 wherein said bowler actions include location of a placement of the bowler's feet at a start of the bowler's approach required to deliver the ball to said target portion.

35. The method of advising a bowler of a strategy for converting a leave in a bowling scoring system in claim 26 including receiving user selection of the hand used by the bowler to deliver the ball and wherein said determining the bowler's actions is at least partially a function of the user selection of the hand used by that bowler to deliver the ball.

36. The method of advising a bowler of a strategy for converting a leave in a bowling scoring system in claim 26 including automatically determining a measure of difficulty of converting the pattern of pins standing and displaying said measure on said display device.

37. The method of advising a bowler of a strategy for converting a leave in a bowling scoring system in claim 26 including automatically determining whether the pattern of pins standing is considered a split and displaying on said display device whether the pattern of pins standing is considered a split.

* * * * *

UNITED STATES PATENT AND TRADEMARK OFFICE

CERTIFICATE OF CORRECTION

PATENT NO. : 5,618,238
DATED : April 8, 1997
INVENTOR(S) : Kruse et al.

It is certified that error appears in the above-identified patent and that said Letters Patent is hereby corrected as shown below:

Col. 2, line 22, "requiting" should be --requiring--;

Col. 4, line 42, "much-screen" should be --touch-screen--;

Col. 8, line 16, "goring" should be --scoring--;

Col. 8, line 54, delete "of", second occurrence;

Col. 11, line 58, "display" should be --displaying--;

Col. 11, line 59, after "device for" insert --advising--;

Col. 12, line 40, "claim 12" should be --claim 11--;

Col. 12, line 44, "claim 12" should be --claim 11--;

Col. 12, line 51, "claim 12" should be --claim 11--;

Col. 12, line 56, "claim 12" should be --claim 11--;

Col. 12, line 61, "claim 12" should be --claim 11--;

Col 13, line 10, after "for" insert -displaying-;

UNITED STATES PATENT AND TRADEMARK OFFICE

CERTIFICATE OF CORRECTION

PATENT NO. : 5,618,238
DATED : April 8, 1997
INVENTOR(S) : Kruse et al.

It is certified that error appears in the above-identified patent and that said Letters Patent is hereby corrected as shown below:

Col. 13, line 60, "mean" should be --means--;

Col. 13, line 61, "score" should be --scores--;

Col. 13, line 64, "couple" should be --coupled--;

Col. 14, line 40, "claim 26" should be --claim 27--; and

Col. 14, line 41, after "wherein" insert --said--.

Signed and Sealed this

Seventh Day of October, 1997

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,618,238
DATED : April 8, 1997
INVENTOR(S) : Kruse et al.

Figure 2A:
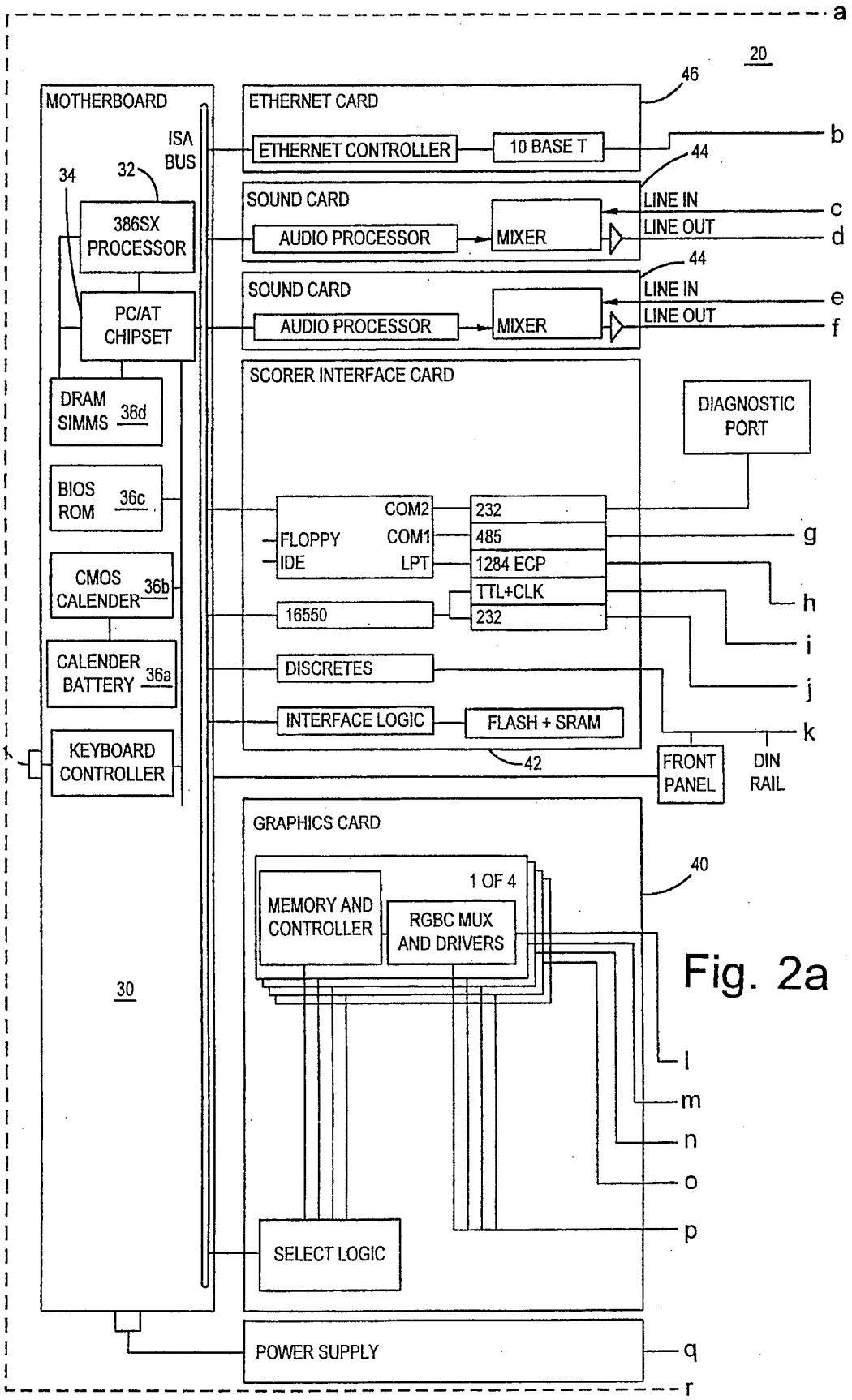
FIG. 2 is an electronic block diagram of the bowling scoring system in FIG. 1.
Figure 2B:
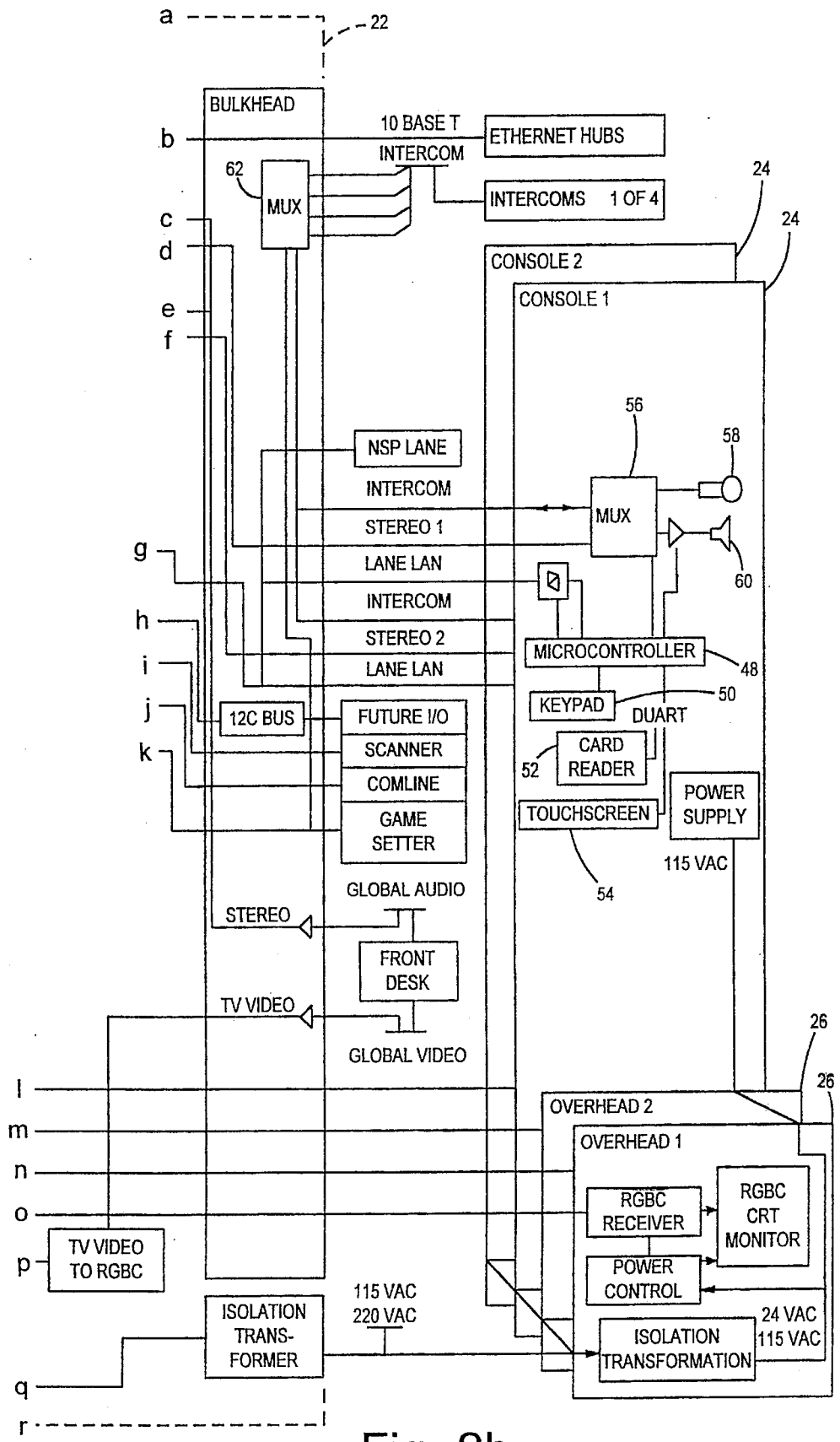

It is certified that error appears in the above-identified patent and that said Letters Patent is hereby corrected as shown below:

Col. 3, line 9, "Fig. 2 is" should be –Figs. 2a and 2b are–;

Col. 3, line 48, "(Fig. 2)" should be –(Figs. 2a and 2b)–;

Signed and Sealed this

Second Day of February, 1999

*Attest:*

*Attesting Officer*

*Acting Commissioner of Patents and Trademarks*